US006290008B1

(12) United States Patent
Portwood et al.

(10) Patent No.: US 6,290,008 B1
(45) Date of Patent: Sep. 18, 2001

(54) INSERTS FOR EARTH-BORING BITS

(75) Inventors: Gary R. Portwood, Kingwood; Michael A. Siracki, The Woodlands, both of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/206,827

(22) Filed: Dec. 7, 1998

(51) Int. Cl.[7] ..... E21B 10/00

(52) U.S. Cl. ..... 175/426; 175/434; 175/420.1; 175/420.2

(58) Field of Search ..... 175/374, 425, 175/426, 434, 420.1, 420.2

(56) References Cited

U.S. PATENT DOCUMENTS

| | | | | |
|---|---|---|---|---|
| 4,148,368 | | 4/1979 | Evans | 175/329 |
| 4,339,009 | | 7/1982 | Busby | 175/374 |
| 4,359,335 | | 11/1982 | Garner | 75/208 R |
| 4,629,373 | | 12/1986 | Hall | 407/118 |
| 4,694,918 | | 9/1987 | Hall | 175/329 |
| 4,722,405 | | 2/1988 | Langford, Jr. | 175/374 |
| 4,832,139 | | 5/1989 | Minikus et al. | 175/374 |
| 4,854,405 | * | 8/1989 | Stroud | 175/374 |
| 4,940,099 | | 7/1990 | Deane et al. | 175/374 |
| 5,131,480 | | 7/1992 | Lockstedt et al. | 175/374 |
| 5,172,777 | | 12/1992 | Siracki et al. | 175/374 |
| 5,205,684 | * | 4/1993 | Meskin et al. | 408/145 |
| 5,248,006 | | 9/1993 | Scott et al. | 175/420.2 |
| 5,273,125 | | 12/1993 | Jurewicz | 175/420.2 |
| 5,282,512 | | 2/1994 | Besson et al. | 175/374 |
| 5,287,936 | | 2/1994 | Grimes et al. | 175/331 |
| 5,322,138 | | 6/1994 | Siracki | 175/374 |
| 5,341,890 | | 8/1994 | Cawthorne et al. | 175/374 |
| 5,351,770 | | 10/1994 | Cawthorne et al. | 175/374 |
| 5,370,195 | | 12/1994 | Keshavan et al. | 175/420.2 |
| 5,379,854 | | 1/1995 | Dennis | 175/434 |
| 5,469,927 | | 11/1995 | Griffin | 175/432 |
| 5,492,188 | * | 2/1996 | Smith et al. | 175/432 |
| 5,499,688 | | 3/1996 | Dennis | 175/426 |
| 5,542,485 | | 8/1996 | Pessier et al. | 175/371 |
| 5,592,995 | | 1/1997 | Scott et al. | 175/374 |
| 5,607,024 | | 3/1997 | Keith et al. | 175/431 |
| 5,667,028 | | 9/1997 | Truax et al. | 175/428 |
| 5,722,497 | * | 3/1998 | Gum et al. | 175/374 |
| 5,722,499 | | 3/1998 | Nguyen et al. | 175/431 |
| 5,746,280 | | 5/1998 | Scott et al. | 175/374 |
| 5,752,573 | | 5/1998 | Scott et al. | 175/374 |
| 5,766,394 | | 6/1998 | Anderson et al. | 156/89.11 |
| 6,068,913 | * | 5/2000 | Cho et al. | 428/212 |

FOREIGN PATENT DOCUMENTS

| | | |
|---|---|---|
| 0 029 535 A1 | 6/1981 | (EP) . |
| 1014433 | 12/1965 | (GB) . |
| 2 293 615 A | 4/1996 | (GB) . |
| 2 324 554 A | 10/1998 | (GB) . |

* cited by examiner

*Primary Examiner*—David Bagnell
*Assistant Examiner*—Jennifer R. Dougherty
(74) *Attorney, Agent, or Firm*—Rosenthal & Osha L.L.P.

(57) ABSTRACT

A polycrystalline diamond enhanced insert is disclosed. The insert includes a body portion adapted for attachment to an earth-boring bit and a top portion for contacting an earthen formation. The top portion of the insert is provided with two different compositions of polycrystalline diamond. In the primary surface of the top portion, a tougher or less wear-resistant polycrystalline diamond layer is provided, whereas a more wear-resistant polycrystalline diamond layer is provided in the remaining region of the top portion. In addition to polycrystalline diamond, polycrystalline boron nitride and other superhard materials also may be used.

68 Claims, 16 Drawing Sheets

INSERTS FOR EARTH-BORING BITS

FIELD OF THE INVENTION

This invention relates to earth-boring bits with superhard material enhanced inserts for drilling blast holes, oil and gas wells, and the like.

BACKGROUND OF THE INVENTION

Earth-boring bits, such as roller cone rock bits and percussion rock bits, may be employed for drilling oil wells through rock formations, or for drilling blast holes for blasting in mines and construction projects. Earth-boring bits also are referred to as drill bits. During operation, a drill bit is connected to the end of a drill string and rotated to drill through the earth. One variety of drill bits, the roller cone rock bits, have a plurality of wear-resistant inserts secured in rotatable cones attached to a bit body. The inserts usually have a substantially cylindrical body portion which is adapted to fit in a cylindrical hole in the roller cone and a top portion which protrudes from the roller cone for contacting an earthen formation.

When a roller cone rock bit is used to drill a borehole, it is important that the diameter or "gage" of the borehole be maintained at a desired value. The first row of inserts from the center of the rock bit on each roller cone that cuts to a full gage borehole typically is referred to as the "gage row." This row of inserts generally is subjected to the greatest wear, as it both reams the borehole wall and cuts the corner of the borehole. As the gage row inserts wear, the diameter of the borehole being drilled may decrease below the original gage diameter of the rock bit. When the bit is worn out and removed, the diameter of the bottom portion of the hole may be less than the gage diameter, or "under-gage." When the next bit is run in the hole, it is required to ream that bottom portion of the borehole to bring it to the full gage diameter. This not only takes substantial time but also adds to the wear on the gage row inserts of the next bit. This additional wear on the gage row inserts may result in an increased length of under-gage borehole as the bit wears out.

In addition to gage row inserts, a conventional bit typically includes a number of inner row inserts located on a roller cone and disposed radially inward from the gage row. These inner row inserts are sized and configured for cutting the bottom of the borehole. Sometimes, a conventional bit also may include a plurality of secondary inserts located between the gage row inserts. These inserts, referred to as "nestled gage inserts," typically cut the full gage of the borehole and also assist the gage inserts in cutting the borehole corner. Moreover, a conventional rock bit may further include a row of heel inserts located on the frustoconical surface of a roller cone. The heel row inserts generally scrape and ream the side wall of a borehole as the roller cone rotates about its rotational axis.

The performance of a rock bit is measured, in part, by total drilling footage and rate of penetration. As the inserts on a rock bit wear, the rate of penetration typically decreases. When the inserts have been substantially worn out, it is no longer economical to continue drilling that bit, and the bit is replaced. The amount of time required to make a "round trip" for replacing a bit, i.e., pull all of the drill string out of the borehole, replace the worn-out bit, and reassemble the drill string into the borehole, essentially represents time lost from actual drilling. This time can become a significant portion of the total time for completing a well. Therefore, it is highly desirable to design and manufacture inserts that would increase the rate of penetration and total drilling footage of a rock bit. In particular, there have been numerous attempts to reduce wear on the gage row inserts to increase the length of a borehole drilled to full gage.

Two kinds of wear-resistant inserts typically are used in a rock bit—tungsten carbide inserts and polycrystalline diamond ("PCD") enhanced inserts. Tungsten carbide inserts are formed of cemented tungsten carbide. A typical composition for cemented tungsten carbide is tungsten carbide particles dispersed in a cobalt binder matrix. The PCD enhanced insert, an improvement over the tungsten carbide insert, typically includes a cemented tungsten carbide body as a substrate and a layer of polycrystalline diamond directly bonded to the tungsten carbide substrate on the top portion of the insert.

Although the polycrystalline diamond layer is extremely hard and wear-resistant, a PCD enhanced insert still may fail during normal operation. The typical failure mode is cracking of the polycrystalline diamond layer due to high contact stress, lack of toughness, and insufficient fatigue strength. A crack in the polycrystalline diamond layer during drilling may cause the polycrystalline diamond layer to spall or delaminate. Furthermore, a crack in the polycrystalline diamond layer may propagate through the cemented tungsten carbide body of the insert and cause more massive failure of the insert. On the other hand, wear of the polycrystalline diamond layer can be a failure mode leading to failure of an insert, particularly in percussion rock bits.

For the foregoing reasons, there exists a need for PCD enhanced inserts that possess not only high hardness but also desired toughness and other properties to drill through rock formations without premature breakage or delamination of the polycrystalline diamond layer.

SUMMARY OF THE INVENTION

The invention meets the aforementioned need by the following aspects. In one aspect, the invention relates to an insert for an earth-boring bit. The insert comprises a body portion adapted for attachment to the earth-boring bit and a non-cylindrical top portion for contacting an earthen formation to be drilled. The top portion includes superhard material having a first region and a second region, and the superhard material in the first region has a composition different from the superhard material in the second region. In some embodiments, the top portion includes a substrate and a layer of the superhard material provided over at least a portion of the substrate. The superhard material in the first region may have a higher toughness (or lower hardness) than the superhard material in the second region. Moreover, the first region may lie in the primary surface of the insert. In some embodiments, the hardness of the superhard material in the first region is at least 500 Vickers lower than the hardness of the superhard material in the second region. Superhard material may include diamond and cubic boron nitride.

In another aspect, the invention relates to a polycrystalline diamond enhanced insert for an earth-boring bit. The insert comprises a substantially cylindrical body portion adapted for attachment to the earth-boring bit and a non-cylindrical top portion for contacting an earthen formation to be drilled. The body portion is formed of cemented tungsten carbide, and the top portion has a primary surface and secondary surface. The top portion includes a cemented tungsten carbide substrate and a polycrystalline diamond layer over at least a portion of the substrate. The polycrystalline diamond in the primary surface has a lower wear resistance than the polycrystalline diamond in the secondary surface of the top portion.

In still another aspect, the invention relates to a rock bit. The rock bit comprises a bit body, a roller cone rotatably mounted on the bit body, and an insert with a body portion and a top portion. The body portion is secured in the roller cone, and the top portion includes superhard material with a first region and a second region. The superhard material in the first region has a composition different from the superhard material in the second region. The top portion of the insert may be cylindrical or non-cylindrical. The insert may be a gage row insert, an inner row insert, a nestled gage row insert, heel row inserts, etc. In some embodiments, the first region lies in the gage contact face of the insert, and the superhard material in the first region is less wear resistant than the superhard material in the second region.

In yet another aspect, the invention relates to a rock bit. The rock bit comprises a bit body, a roller cone rotatably mounted on the bit body, and a plurality of inserts with a substantially cylindrical body and a non-cylindrical top portion. The body portion is secured in the roller cone, and the top portion includes a substrate and a polycrystalline diamond layer over at least a portion of the substrate. The top portion has a primary surface and secondary surface. The polycrystalline diamond in the primary surface has a higher toughness or lower wear resistance than the polycrystalline diamond in the secondary surface of the top portion.

In yet still another aspect, the invention relates to an earth-boring bit. The earth-boring bit comprises a retention body and an insert with a body portion and a non-cylindrical top portion. The body portion is secured in the retention body, and the top portion includes superhard material with a first region and a second region. The superhard material in the first region has a composition different from the superhard material in the second region.

In one aspect, the invention relates to a rock bit. The rock bit comprises a bit body, and a roller cone rotatably mounted on the bit body. The roller cone has cutting elements integrally formed thereon, and the cutting elements include superhard material with a first region and a second region. The superhard material in the first region has a composition different from the superhard material in the second region.

In another aspect, the invention relates to a method of manufacturing an insert. The method comprises (a) providing an insert with a body portion and a non-cylindrical top portion; and (b) providing superhard material over at least a portion of the top portion of the insert. The superhard material has a first region and a second region. The superhard material in the first region has a composition different from the superhard material in the second region. Preferably, the hardness of the superhard material in the first region is at least 500 Vickers lower than the hardness of the superhard material in the second region. In some embodiments, a layer of the superhard material is formed under a high pressure and temperature condition for sintering the superhard material. Furthermore, a high-shear compaction tape including a composition for the superhard material may be used for forming the layer of superhard material. A composite construction material including a composition for the superhard material also may be used for forming the layer of superhard material.

In still another aspect, the invention relates to a method of manufacturing a rock bit. The method comprises (a) providing a bit body; (b) rotatably mounting a roller cone to the bit body; and (c) attaching an insert to the roller cone. The insert has a body portion secured in the roller cone and a top portion. The top portion includes superhard material with a first region and a second region. The superhard material in the first region has a composition different from the superhard material in the second region.

In yet another aspect, the invention relates to a method of manufacturing an earth-boring bit. The method comprises (a) providing a retention body; and (b) attaching an insert to the retention body. The insert has a body portion and a non-cylindrical top portion. The body portion is secured in the retention body, and the top portion includes superhard material with a first region and a second region. The superhard material in the first region has a composition different from the superhard material in the second region.

In yet still another aspect, the invention relates to a method of manufacturing a rock bit. The method comprises (a) providing a roller cone having cutting elements integrally formed thereon; (b) providing superhard material over at least a portion of the surface of the cutting elements; and (c) rotatably mounting the integrated roller cone to a leg of a bit body. The superhard material has a first region and a second region, and the superhard material in the first region has a composition different from the superhard material in the second region.

DETAILED DESCRIPTION OF THE PREFERRED EMBODIMENTS

Embodiments of the invention provide improved inserts for an earth-boring bit that include a body portion adapted for attachment to the earth-boring bit and a non-cylindrical top portion for contacting an earthen formation to be drilled. The top portion includes superhard material with two or more regions. The superhard material in a first region has a composition different from the superhard material in a second region. Embodiments of the invention are based, in part, on the realization that different regions of an insert encounter different loading conditions and consequently, different stresses, i.e., tensile, compressive, fatigue, etc. It is believed that wear of a polycrystalline diamond layer on a typical PCD enhanced insert is not the dominate mode of failure of such an insert. Rather, a PCD enhanced insert fails due to chipping and breakage of the polycrystalline diamond layer and the tungsten carbide substrate. A homogeneous polycrystalline diamond layer on an insert (as has been practiced in prior art) is not optimized for handling non-uniform loading and wear conditions. Therefore, a polycrystalline diamond layer with multiple regions having different wear resistance and toughness characteristics on a wear-resistant PCD enhanced insert may be better suited to handle the different loading and wear conditions.

Figure 1A:
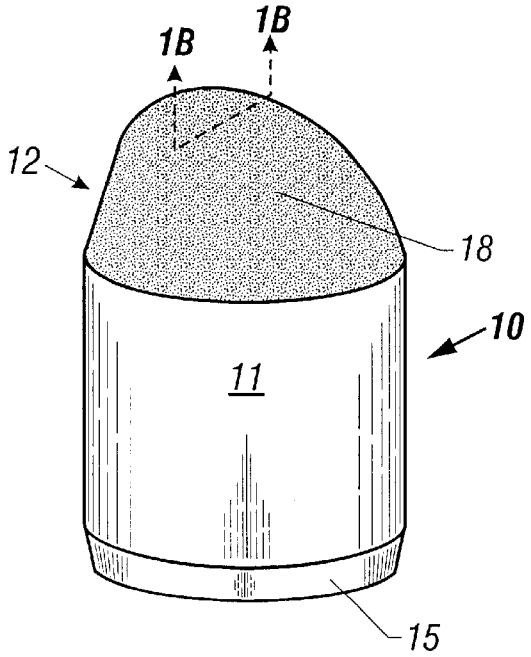
FIG. 1A (PRIOR ART)
FIG. 1A is a perspective view of a prior art PCD enhanced insert with a chisel shaped top portion.
Figure 1C:
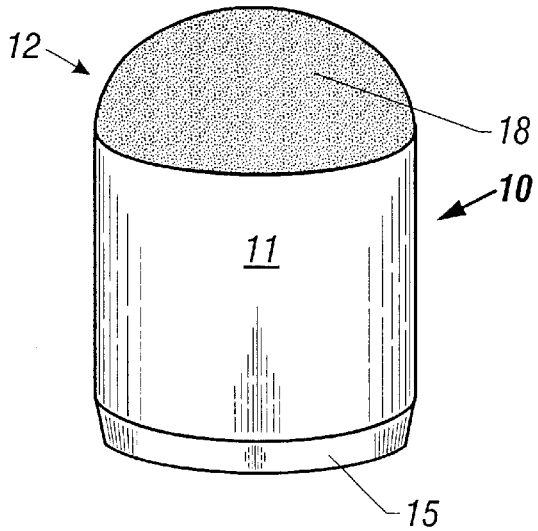
FIG. 1C (PRIOR ART)
FIG. 1C is a perspective view of a prior art PCD enhanced insert with a semi-round top portion.
Figure 1B:
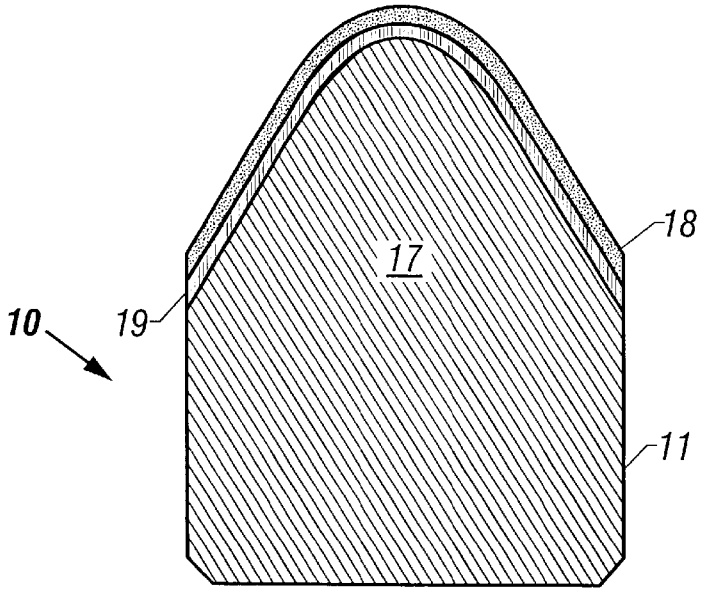
FIG. 1B (PRIOR ART)
FIG. 1B is a cross-sectional view of the prior art PCD enhanced insert of FIG. 1A taken along the line 1B—1B.

FIG. 1A shows a perspective view of a typical prior art PCD enhanced insert, and FIG. 1B is a cross-sectional view of the prior art PCD enhanced insert. An insert 10 includes a cylindrical body portion 11 and a top portion 12. A substantially homogeneous layer of polycrystalline diamond 18 typically is overlaid on all of the faces of the top portion 12. The polycrystalline diamond layer 18 is bonded to a tungsten carbide insert 17 which serves as a substrate. Optionally, there may be one or more transition layers 19 between the polycrystalline diamond layer 18 and the substrate 17 that reduce the residual stress that develops because of the thermal expansion differences between the polycrystalline diamond and tungsten carbide materials.

Because the polycrystalline diamond layer 18 has a substantially homogeneous composition throughout the surface of the top portion 12 of the prior art insert 10, the wear resistance of the polycrystalline diamond layer throughout the entire surface of the top portion 12 is uniform. However, during use, different regions of the top portion 12 experience dissimilar loading, wear, and impact forces, and therefore, have different requirements for strength, wear resistance, and toughness, which are not met by the prior art insert 10.

For example, when the insert 10 of FIG. 1C (which shows an insert with a semi-round top portion) is used in a percussion rock bit, it experiences heaviest wear in certain regions of the insert. In this instance, it is desirable to provide a more wear-resistant polycrystalline diamond layer in this region than in other regions of the insert.

On the other hand, when the insert 10 of FIG. 1A is used in a roller cone bit, no significant wear occurs in the polycrystalline diamond layer. Instead, chipping and breakage of the polycrystalline diamond layer may occur. This is because some regions of the insert, e.g., the primary surface (illustrated in FIG. 2), experience substantially higher impact and/or loading forces than other regions of the insert. The impact force can initiate cracks on the surface of the polycrystalline diamond layer where the insert contacts the earthen formation. Localized chipping of the polycrystalline diamond layer may occur when the crack length reaches a critical level. After the formation of localized chipping of the polycrystalline diamond layer, several events may occur, including (1) crack propagation into the tungsten carbide substrate; (2) spalling and/or peeling of the polycrystalline diamond layer; and (3) creation of a wear flat on the tungsten carbide substrate. The formation of a wear flat, although less frequent, is due to loss of the polycrystalline diamond layer surrounding the wear flat and the wear of exposed carbide substrate. As the polycrystalline diamond layer chips, spalls, and peels off, substantial loss of the wear-resistant material on the insert may occur, which typically leads to eventual destruction of the insert and loss of cutting efficiency. These stages of events leading to failure of an insert are typical for inner row inserts, gage inserts, nestled gage inserts, and heel row inserts.

To overcome the problems of chipping and breakage of the polycrystalline diamond layer, it is desirable to incorporate a less wear-resistant polycrystalline diamond layer in the area or region of an insert where it is subjected to higher impact forces and/or fatigue loading. By providing a less wear resistance polycrystalline diamond layer in this area, preferential wear is promoted in this area. As the polycrystalline diamond in this area is worn away in a more controlled fashion, chipping and breakage of the polycrystalline diamond layer may be minimized. It should be noted that a tougher polycrystalline diamond layer also may have the same or similar effects. This is because a tougher polycrystalline diamond layer generally is more resistant to impact forces.

Because different areas of the top portion of an insert are subjected to different loading, wear, fatigue, impact forces, and associated stresses, the polycrystalline diamond layer on the top portion should be made up of two or more regions. Each region should be provided with a polycrystalline diamond layer with wear resistance, strength, and toughness commensurate with the wear and loading conditions for that particular region or area, instead of a uniform layer of polycrystalline diamond.

Generally, polycrystalline diamond possesses mechanical properties similar to a ceramic material, i.e., the hardness or wear resistance of a polycrystalline diamond layer generally is inversely related to its toughness or fracture strength. As the hardness or wear resistance increases, the toughness decreases, and vice versa. However, there may be exceptions to this inverse relationship. There are at least two ways to minimize chipping and breakage of a polycrystalline diamond layer: use of a less wear resistant polycrystalline diamond layer and provision of a tougher polycrystalline diamond layer.

In embodiments of the invention, a polycrystalline diamond layer with higher toughness or lower wear resistance is provided in the region of an insert where it is subjected to substantially higher impact forces and/or fatigue loading to minimize localized chipping of the polycrystalline diamond on the insert. In the meantime, a polycrystalline diamond layer with higher hardness or wear resistance is provided to the regions of the insert where hardness and wear resistance is required. PCD enhanced inserts with such configuration should be capable of reducing the formation and propagation of localized chipping of a polycrystalline diamond layer, thus lengthening the life of the inserts. It has been determined that a difference of hardness of at least 500 Vickers between the two regions may be sufficient to help alleviate chipping and/or breakage of the polycrystalline diamond layer.

Inserts with such configuration may have additional beneficial properties. For example, when a less wear-resistant polycrystalline diamond layer is placed in the primary surface of an insert, the polycrystalline diamond layer in this primary surface preferentially will wear more rapidly. Once the lower wear-resistant diamond wears away, exposing the substrate material below it, edges of the adjacent polycrystalline diamond layer (that have a higher wear resistance) are exposed. Such a polycrystalline diamond cutting edge can provide a shearing cutting action which is more efficient when cutting a borehole wall. The formation of the polycrystalline diamond cutting edge in a shearing action may help increase the rate of penetration of a rock bit incorporating these types of improved inserts.

The improved inserts according to embodiments of the invention may include two or more regions of different superhard material compositions. Furthermore, any two regions need not be adjacent to each other; nor need they form a contiguous layer. The top portion may include a substrate over which the superhard material is provided. In this case, the substrate of the top portion may be partially exposed, so long as two or more regions of the carbide substrate are covered by superhard material with different compositions. Also, a connecting region between two or more regions of different superhard material composition may be formed of a gradient material composition to avoid drastic discontinuities that could occur due to substantially different compositions.

It should be understood that a superhard material composition may differ in a variety of ways. For example, it may differ by chemical components, weight percentage of the chemical components, and physical characteristics of each component (such as particle size and particle size distribution). Furthermore, two superhard material compositions also are considered different if they have different wear resistance, toughness, or other mechanical properties. For example, two regions could have the same material composition but be processed differently to result in different mechanical properties.

As mentioned above, an insert includes a body portion adapted for attachment to an earth-boring bit and a top portion for contacting an earthen formation. The top portion typically is integral with the body portion, although it need not be. When the body portion is secured in a roller cone, the top portion protrudes from the roller cone. The top portion generally refers to the part of the insert that protrudes from the roller cone.

In some embodiments, a top portion includes a substrate and a layer of superhard material over at least a portion of the substrate. The substrate may be formed of carbide, nitride, silicide, and other suitable materials. Preferably, cemented tungsten carbide in a cobalt matrix is used as the material for the substrate. Generally, the body portion is formed of the same material as the substrate of the top portion. However, it is entirely feasible to manufacture inserts with the body portion and the substrate being formed of different materials.

The top portion may take any shapes, cylindrical or non-cylindrical. Preferably, the entire top portion has a non-cylindrical shape, e.g., ballistic, conical, semi-round, symmetrical, asymmetrical, chisel-shaped, inclined chisel-shaped, etc. The term "non-cylindrical" refers to any three-dimensional shape that is not a cylinder. A cylinder is a solid or hollow body having its figure traced out when a rectangle rotates 360° using one of its sides as the axis of rotation. Although the entire top portion is non-cylindrical, it still may include a part that is cylindrical.

Each top portion has an outer surface (i.e., the entire surface of the top portion) for contacting a formation which comprises a primary surface and a secondary surface. The term "primary surface" herein refers to the area or surface that substantially contacts a borehole or substantially parallels the sidewall of a borehole. The contact can occur at the sidewall, the bottom, or a portion of the corner of a borehole. The secondary surface is the remainder of the outer surface of a top portion.

Figure 2:
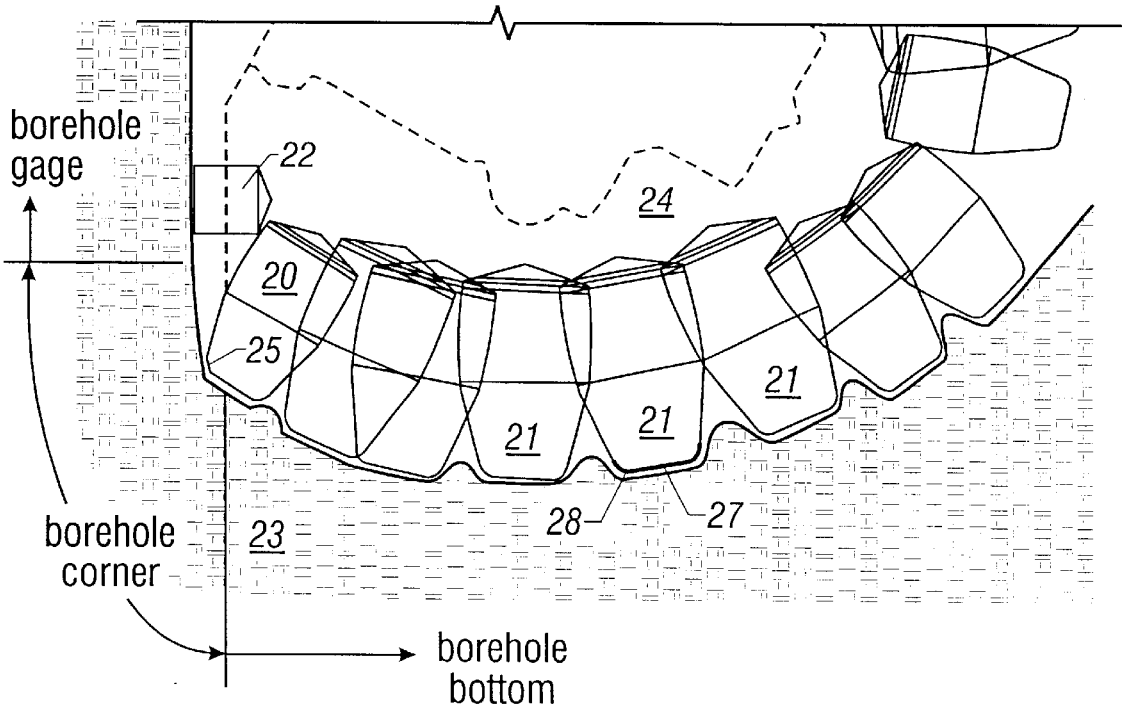
FIG. 2 is an overlay of all three roller cones of a rock bit and their respective inserts rotated into the same plane.

FIG. 2 illustrates the meaning of "primary surface." It is a sectional view of an overlay of all three roller cones of a tri-cone rock bit and their respective rows of inserts rotated into the same plane. Referring to FIG. 2, the roller cones collectively indicated as 24 include a heel row insert 22, a gage row insert 20, and a plurality of inner row inserts 21. The gage row insert 20 contacts the wall surface 23 of the borehole at the borehole corner. The point or area of contact 25, on the insert 20, between the wall surface 23 and the gage row insert 20 generally is referred to as the primary surface for gage row inserts. This surface sometimes is referred to as the "gage contact area" or the "wear face." Similarly, there also exists an area of contact between a heel row insert and the borehole sidewall. Inner row inserts 21 generally contacts the formation at the crest area (indicated by the boldface) 27 and the outer corner 28. Therefore, these areas are referred to as the primary surface.

Sometimes, it is desirable to provide an additional row of gage cutting inserts on a roller cone, known as "nestled gage inserts" or "secondary gage insets". The nestled or secondary gage inserts are located between the conventional gage inserts 20 on the gage row of a roller cone. These additional inserts generally help cut and maintain the borehole to its intended diameter. They also may cut the corner of the borehole. The location of the primary surface on a nestled gage insert is similar to that on a gage insert.

Figure 3A:
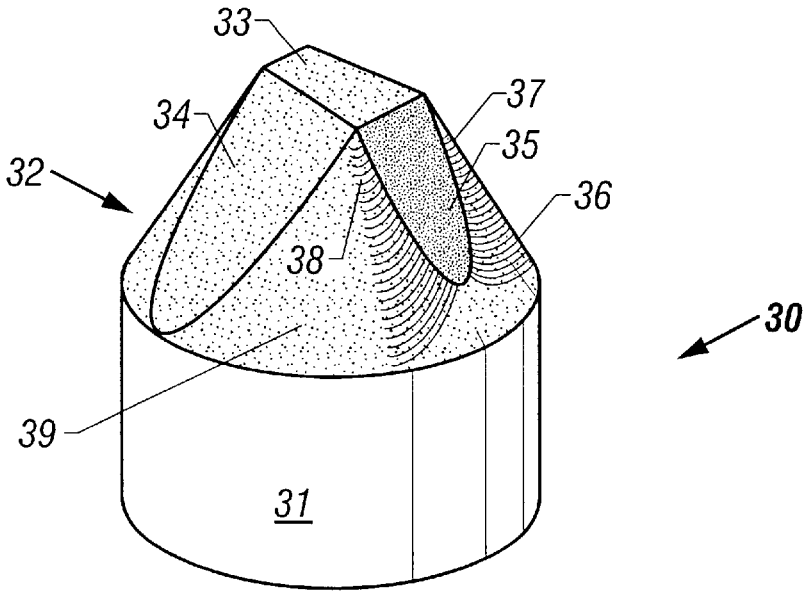
FIG. 3A is a perspective view of an improved PCD enhanced insert according to one embodiment of the invention.
Figure 3B:
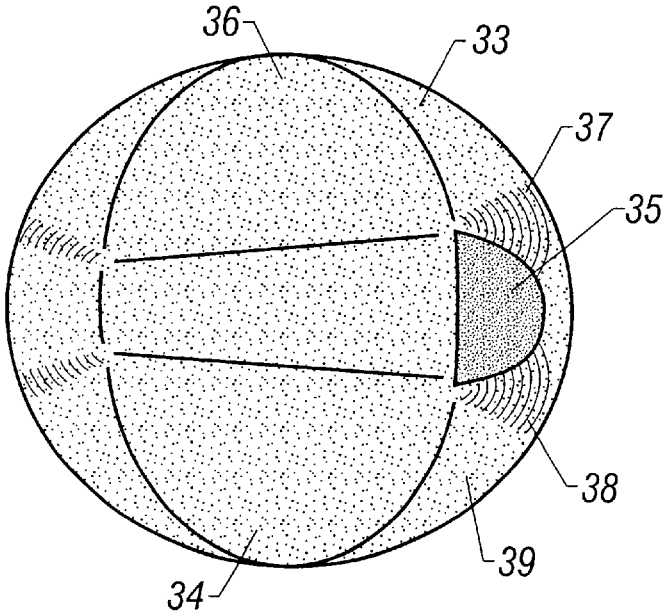
FIG. 3B is a top view of the improved PCD enhanced insert of FIG. 3A.

One embodiment of the improved insert is illustrated as a gage row insert in FIGS. 3A and 3B. Referring to FIG. 3A, an improved insert 30 includes a body portion 31 and a top portion 32. The body portion 31 generally is secured in a roller cone and may take a variety of geometrical shapes. In a preferred embodiment, the body portion 31 is substantially cylindrical.

Referring to FIGS. 3A and 3B, the chisel-shaped top portion 32 includes a leading face 36, a trailing face 34, a leading edge 37, a trailing edge 38, a crest 33, and an outer lateral face 35 (which is optional). The outer lateral face sometimes is referred to as "wear face." FIG. 3B is a top view of the top portion 32. It should be noted that the surface of the top portion 32 is provided with a layer of superhard material which is divided into at least two regions 35 and 39. The region 35 includes a superhard material that has a different composition from the superhard material in region 39. In this embodiment, the region 35 lies in the primary surface of the insert, and it also coincides with the entire outer lateral face. However, in other embodiments, only a portion of the outer lateral face is provided with a layer of superhard material different from that of another region.

The leading edge and face are defined, respectively, as the area or face of the top portion of an insert on a rock bit that first contacts an earthen formation as the bit rotates. The trailing edge and face are respectively the area or face of the top portion opposite the leading edge. The trailing edge contacts the formation after the leading edge as the roller cone rotates. The terms "leading" and "trailing" are used herein to refer to these areas respectively, regardless of whether the areas so referred to are planar, contoured, or include an edge.

Figure 4A:
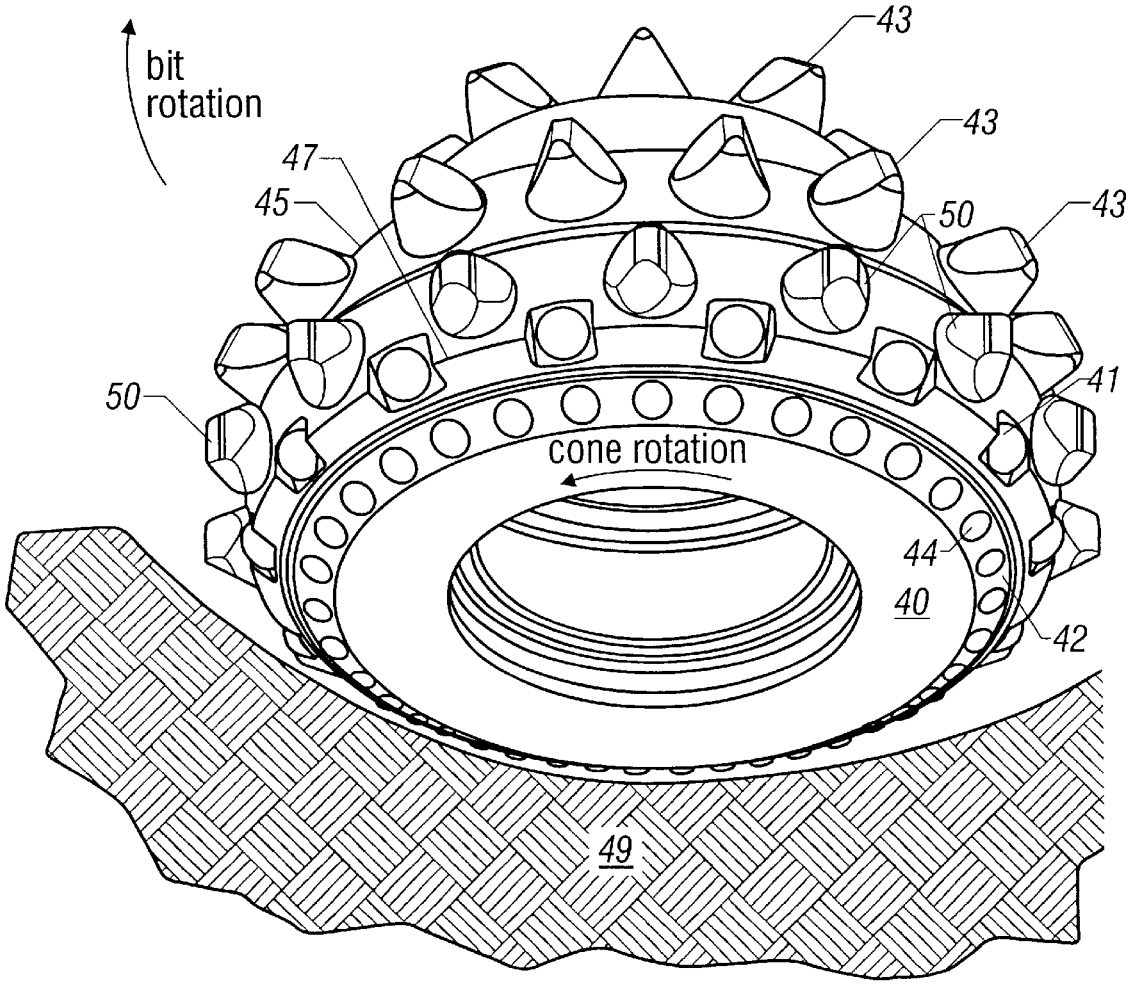
FIG. 4A is a perspective view of one roller cone of a rock bit in a borehole as viewed from the top of the borehole down to the bit while drilling.
Figure 4B:
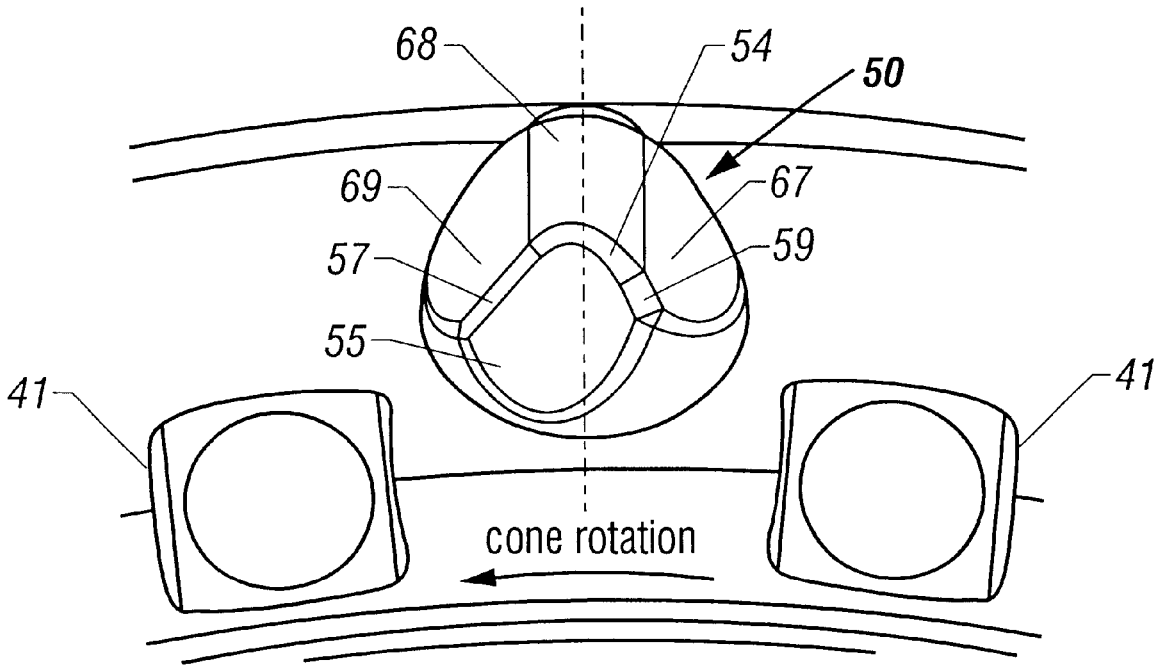
FIG. 4B is an enlarged view of the insert 50 of FIG. 4A showing the location of the leading edge, trailing edge, and outer lateral face.

FIG. 4A and FIG. 4B illustrate the concept of "leading" and "trailing." FIG. 4A is a perspective view of a roller cone of a rock bit in a borehole as viewed from the top of the borehole down to the bit while drilling. A roller cone 40 includes heel row inserts 44, off-gage row inserts 50, gage row inserts 41, and inner row inserts 43. It should be noted that FIG. 4A and FIG. 4B illustrate a Trucut™ bit design of Smith International, Inc., in which the off-gage inserts 50 are used in conjunction with the gage row inserts 41 located on the gage row 47. Furthermore, the off-gage inserts have a chisel-shaped top portion, whereas the gage inserts have a semi-round top portion (although any other shapes also are acceptable). In this design, no nestled gage inserts are present. However, the gage inserts 41 would be considered as nestled gage inserts if the off-gage inserts 50 were moved to the gage row 47.

Figure 4C:
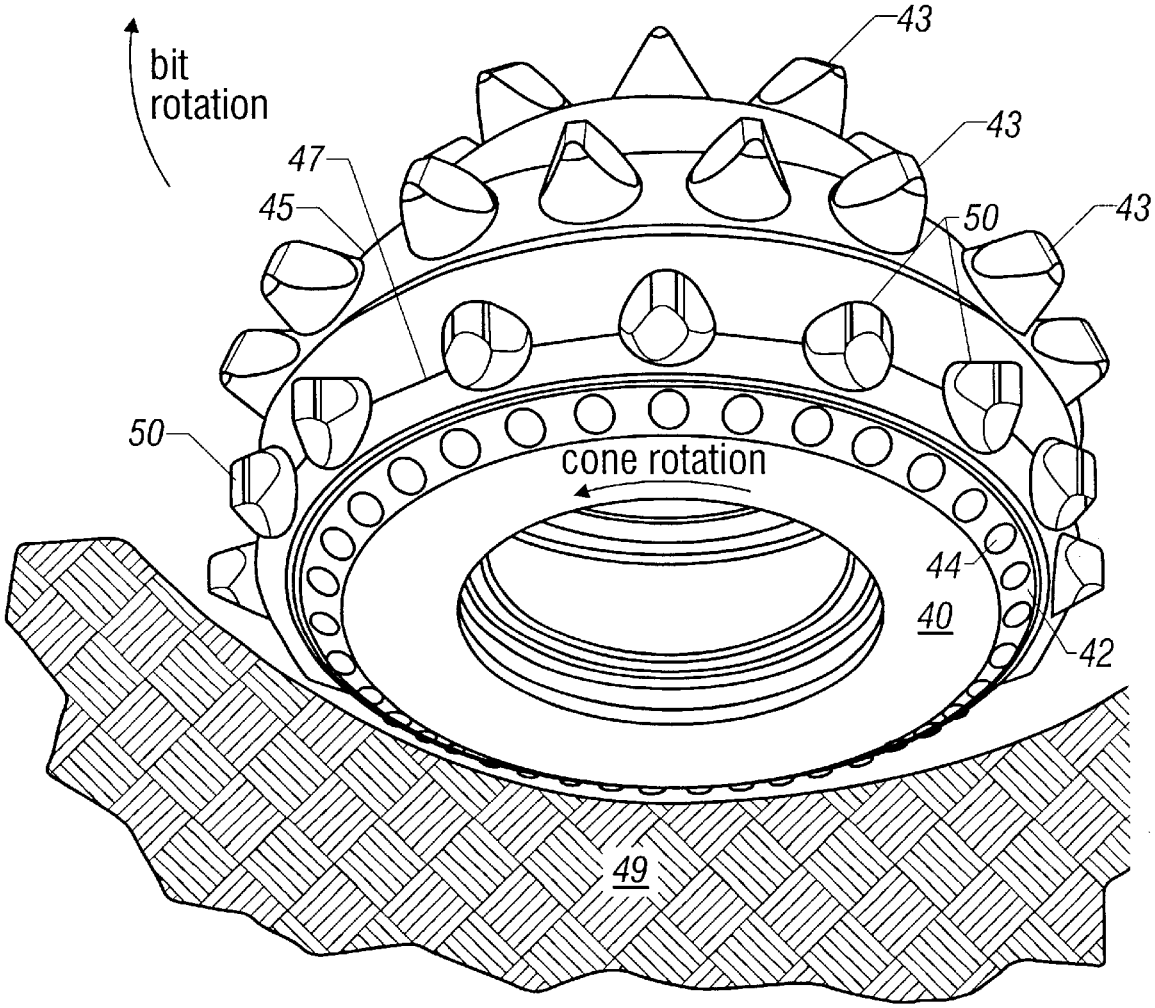
FIG. 4C is a perspective view of another roller cone of a rock bit in a borehole as viewed from the top of the borehole down to the bit while drilling.

It should be understood that variations with respect to the location and insert geometry may exist for different bit designs. However, the same "leading" and "trailing" concepts apply to any conventional bit design. One such example of a conventional bit design is illustrated in FIG. 4C. In this design, there are no off-gage inserts, and the gage inserts have a chisel-shaped top portion.

Figure 5A:
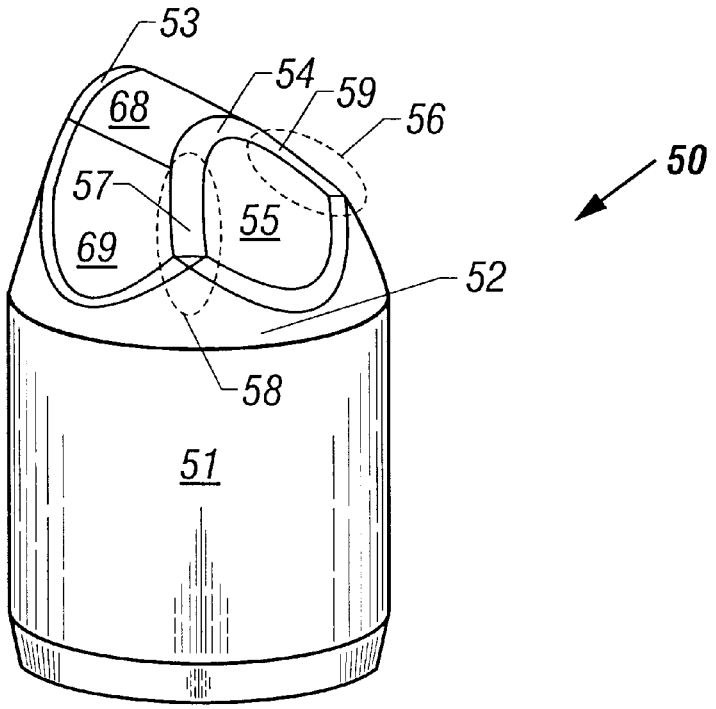
FIG. 5A is a perspective view of an insert showing various faces of the top portion of the insert.
Figure 5B:
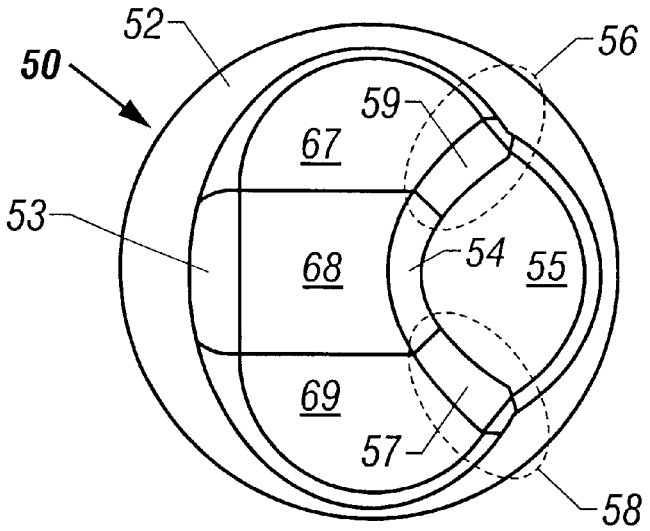
FIG. 5B is a top view of the insert of FIG. 5A.

Referring to FIG. 4B, the insert 50 includes a leading edge 59, a leading face 67, a trailing edge 57, a trailing face 69, an outer lateral face 55, a crest 68, and an outer edge 54. As the rock bit (not shown) rotates clockwise in a borehole, the roller cone 40 rotates counterclockwise. As such, the leading edge 59 and the leading face 67 contact the formation first, and the trailing edge 57 and the trailing face 69 contact the formation later. It should be understood that the location of the respective faces or edges on the same insert will be reversed if the roller cone rotates in the opposite direction. For a known direction of bit rotation, the respective locations of the leading and trailing edges or faces may be readily determined. FIG. 5A and FIG. 5B illustrate the relative location of a leading face 67, a leading edge 59, a trailing face 69, a trailing edge 57, an outer lateral face 55, a crest 68, and an outer edge 54. In this embodiment, portions of the leading face 67, the outer lateral face 55, the leading edge 59, and the outer edge 54 collectively make up a leading transition 56. Similarly, portions of the trailing face 69, the outer lateral face 55, the trailing edge 57, and the outer edge 54 collectively make a trailing transition 58. It should be understood that, in embodiments of the invention, any one of the aforementioned areas or faces is considered as a separate region and thus may be provided with a superhard material different from another region.

Although it is desirable to provide a tougher or less wear-resistant polycrystalline diamond layer in the primary surface (i.e., gage contact area) of a gage row insert, it is by no means the only desirable region where the tougher or less wear-resistant polycrystalline diamond layer may be provided. Other regions may include, entirely or portions thereof, the leading face 36, the trailing face 34, the crest 33, the leading edge 37, and the trailing edge 38 of FIG. 2A. Moreover, the leading transition region 56 and the trailing transition region 58 of FIG. 5A also may be provided with a layer of tougher or less wear-resistant material.

In some embodiments, the primary surface of an insert is provided with a polycrystalline diamond layer that has a higher toughness or lower wear resistance than the polycrystalline diamond layer in the secondary surface of the insert. The primary surface also could be separated into two or more regions of different polycrystalline diamond compositions to optimize bit performance. In other embodiments, the primary surface of an insert is provided with a polycrystalline diamond layer that has a lower toughness or higher wear resistance than the polycrystalline diamond layer in the secondary surface of the insert.

It should be recognized that inserts with various shapes and surface finishes may be employed in embodiments of the invention. For example, inserts with a contoured surface are especially suitable. Such inserts are disclosed in U.S. Pat. No. 5,322,138. Inclined chisel inserts are disclosed in U.S. Pat. No. 5,172,777. Furthermore, shaped inserts with its outer lateral face relieved or canted also are suitable. Such shaped inserts are disclosed in pending U.S. patent application Ser. No. 08/879,872, entitled "Non-Symmetrical Stress-Resistant Rotary Drill Bit Cutter Element," filed Jun. 3, 1997. The disclosure of this application is incorporated by reference herein in its entirety.

Figure 6A:
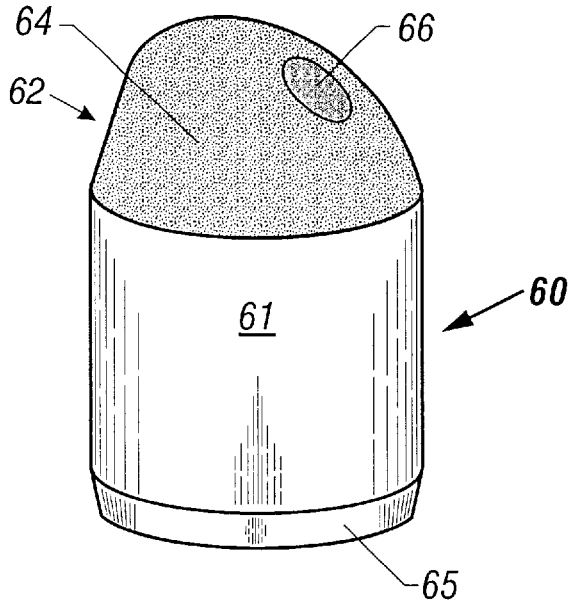
FIG. 6A is a perspective view of another embodiment of an improved PCD enhanced insert with an inclined chisel-shaped top portion according to the invention.
Figure 6B:
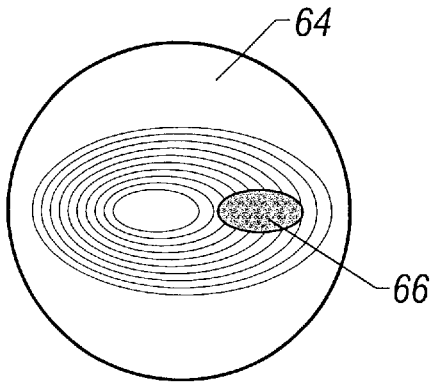
FIG. 6B is a top view of the improved PCD enhanced insert of FIG. 6A.
Figure 6C:
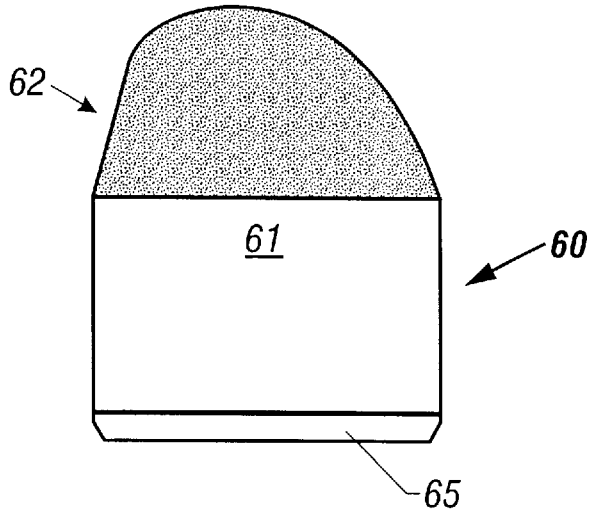
FIG. 6C is a side view of the improved PCD enhanced insert of FIG. 6A.

FIG. 6A is a perspective view of an improved inclined chisel insert with a layer of polycrystalline diamond. The improved insert 60 includes a cylindrical body portion 61 and a top portion 62. The body portion 61 may further include a chamfered base 65. The top portion 62 includes a polycrystalline diamond layer over a carbide substrate (not shown). The polycrystalline diamond layer has at least two distinct areas: region 64 and region 66. The polycrystalline diamond in the region 66 is tougher or less wear-resistant than the polycrystalline diamond in the region 64. Preferably, the region 66 coincides with the primary surface of the insert. However, it is entirely acceptable to place a layer of tougher or less wear-resistant polycrystalline diamond in other areas of the top portion 62. FIG. 6B is a top view of the improved insert 60, and FIG. 6C is a side view of the insert.

Figure 7:
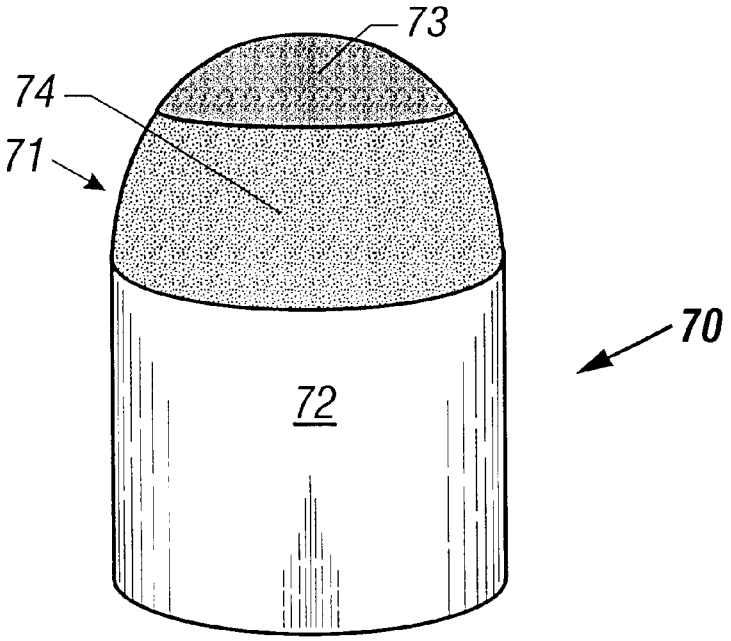
FIG. 7 is a perspective view of an improved insert in accordance with an embodiment of the invention.

FIG. 7 shows a perspective view of an improved insert in accordance with another embodiment of the invention. The improved insert 70 includes a top portion 71 having a conical shape and a body portion 72. The top portion 71 includes a polycrystalline diamond layer 73 at the crest of the top portion and a polycrystalline diamond layer 74 covering the remainder of the top portion. The wear resistance or toughness of the layer 73 differs from that of the layer 74. In some applications, the layer 73 is tougher or less wear-resistant than the layer 74. In other applications, the layer 73 is more wear-resistant or less tough than the layer 74. Such improved inserts are especially suitable as inner row inserts.

Figure 8:
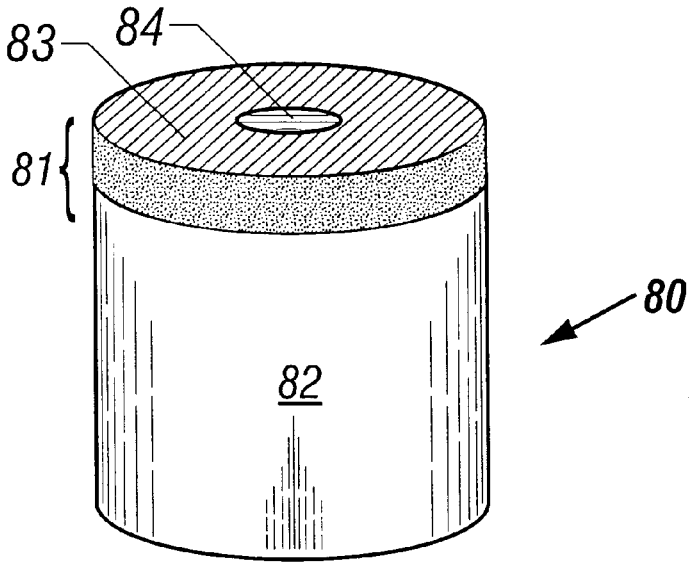
FIG. 8 is perspective view of an improved insert in accordance with another embodiment of the invention.

FIG. 8 shows a perspective view of an improved insert in accordance with still another embodiment of the invention. The improved insert 80 includes a top portion 81 having a flat top and a body portion 82. The top portion 81 includes a first polycrystalline diamond region 83 and a second polycrystalline diamond region 84. It further includes a portion of the carbide substrate beneath the polycrystalline diamond regions that supports the polycrystalline diamond regions. The wear resistance or toughness of the region 83 differs from that of the region 84. In some applications, the region 83 is tougher or less wear-resistant than the region 84. In other applications, the region 83 is more wearresistant or less tough than the region 84. Such improved inserts are especially suitable as heel row inserts.

Figure 9:
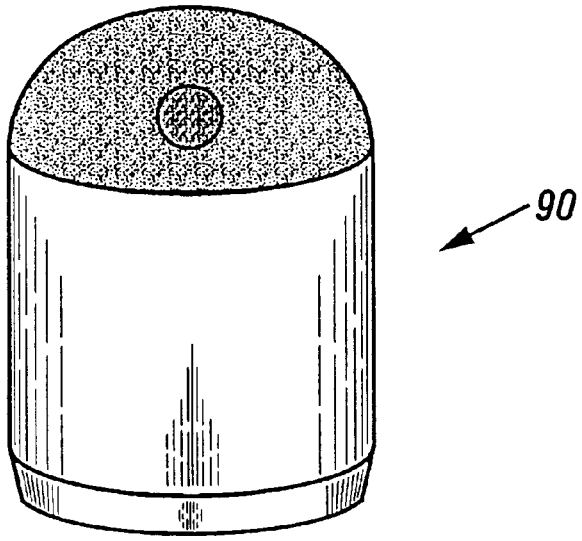
FIG. 9 is a perspective view of still another embodiment of an improved PCD enhanced insert having a semi-round top portion according to the invention.
Figure 10:
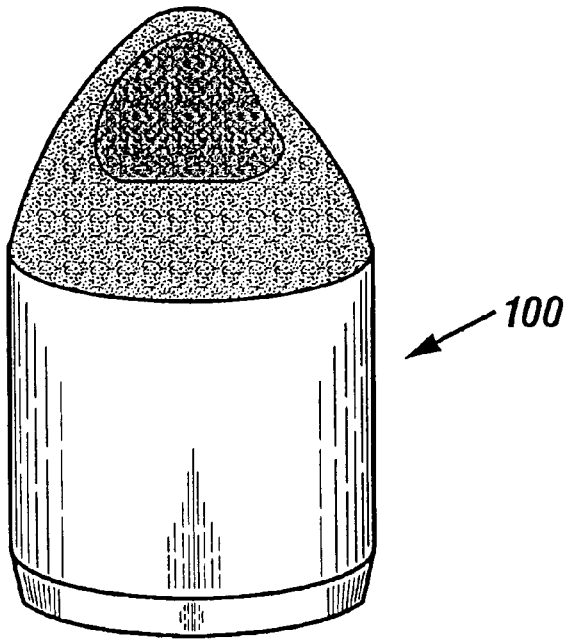
FIG. 10 is a perspective view of yet another embodiment of an improved PCD relieved gage insert having an asymmetrical top portion according to the invention.

In addition to the above geometrical shapes, the top portion of an improved insert may be any other configurations, such as semi-round as illustrated in FIG. 9 and asymmetrical as illustrated in FIG. 10. The construction of the improved insert 90, 100 shown in FIG. 9 and FIG. 10, respectively is similar to the inclined chisel insert of FIGS. 6A–6C described above.

Suitable superhard material includes diamond, cubic boron nitride, and other materials with comparable wear resistance. Generally, wear resistance is proportional to hardness. However, some materials may have high hardness but modest wear resistance. This kind of materials also may be used in embodiments of the invention. It is recognized that the hardness of superhard material is known to some extent. For example, polycrystalline diamond generally has a hardness in the range of about 3,000 to 4,000 Vickers, whereas polycrystalline cubic boron nitride generally has a hardness in the range of about 2,500 to 3,500 Vickers. Some mixtures of carbide and polycrystalline diamond (or polycrystalline cubic boron nitride) are considered superhard material, although they may have a lower hardness than pure diamond or cubic boron nitride. Such mixtures are known to have a hardness of about 2,200 Vickers or higher. These mixtures may be used in embodiment of the invention.

As mentioned above, suitable superhard material includes diamond (which may be either natural or synthetic). Polycrystalline diamond is one form of diamond that can be used in embodiments of the invention. The tern "polycrystalline diamond" refers to the material produced by subjecting individual diamond crystals to a sufficiently high pressure and high temperature that inter-crystalline bonding occurs between adjacent diamond crystals. Typically, polycrystalline diamond may include a metal selected from the group consisting of cobalt, nickel, iron, and alloys thereof. It further may include particles of carbide or carbonitride of elements selected from the group consisting of tungsten, titanium, tantalum, chromium, molybdenum, vanadium, hafnium, zirconium, and alloys thereof. Moreover, other compounds also may be included in polycrystalline diamond if desired.

In preferred embodiments, diamond particles dispersed in the cobalt matrix are used to obtain a polycrystalline diamond layer. It is noticed that the cobalt percentage in the polycrystalline diamond layer affects its wear resistance and toughness. For example, a difference of the cobalt content by about 20% results in different wear resistance in the corresponding polycrystalline diamond layers.

The diamond particle size also can affect toughness and wear resistance. The toughness and the wear resistance of a polycrystalline diamond layer may be varied by changing the average diamond particle size or the cobalt percentage. Toughness and wear resistance also may be varied by adding another component, such as tungsten carbide (WC). In a polycrystalline diamond layer that includes diamond, cobalt, and WC, a noticeable difference in wear resistance is obtained when the WC weight percentage differs by more than about 20%. For example, for a fixed weight percent of cobalt, a polycrystalline diamond layer having less than about 10% by weight of WC is found to have a higher wear resistance than a polycrystalline diamond layer having more than about 30% by weight of WC.

The improved inserts in accordance with embodiments of the invention may be manufactured by any suitable method. In a preferred embodiment, the improved inserts are manufactured by advantageous use of high-shear compaction tapes disclosed in pending U.S. patent application Ser. No. 5,766,394, entitled "Method for Forming a Polycrystalline Layer of Ultra Hard Material," filed on Dec. 6, 1995. The disclosure of this patent application is incorporated by reference herein in its entirety.

The high-shear compaction tape is made from a high-shear compaction material which includes particles of superhard material such as diamond or boron nitride, organic binder such as polypropylene carbonate, and possibly residual solvents such as methyl ethyl ketone. The high-shear compaction tape is prepared in a multiple roller process. Compaction occurs during this process. After the compaction process, the tape is characterized by a high "green" density and uniform distribution of particles. The term "green" refers to the state after compaction but before high-pressure and high temperature sintering. Such high-shear compaction tapes are especially suitable for manufacturing a polycrystalline diamond layer on a tungsten carbide insert in a high pressure and high temperature process.

Figure 11:
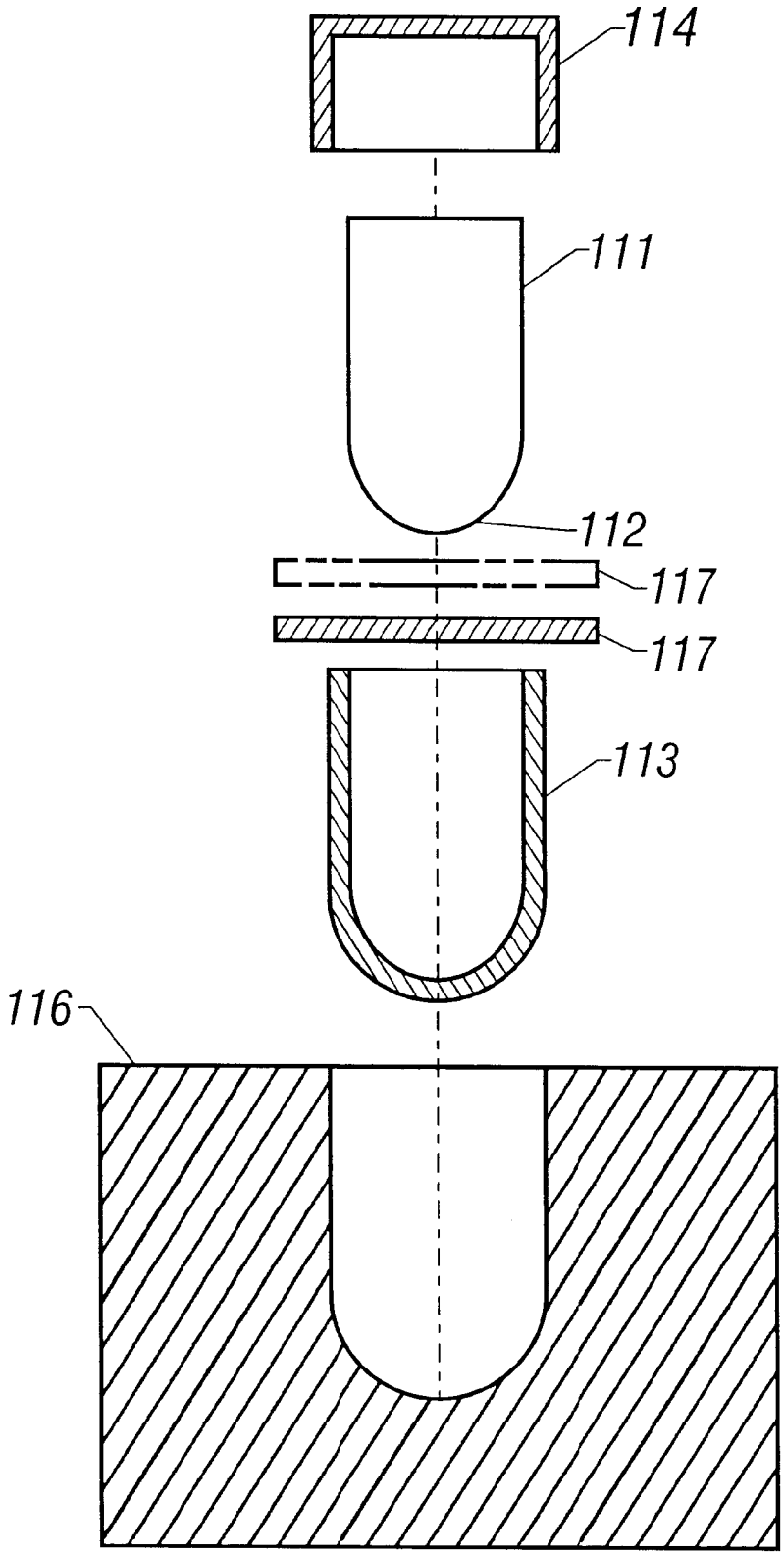
FIG. 11 is a partially sectioned exploded view of components used to fabricate an improved PCD enhanced insert according to an embodiment of the invention.

FIG. 11 illustrates in exploded view components used to fabricate a PCD enhanced insert in accordance with embodiments of the invention. The process starts with a cemented tungsten carbide insert with a body portion 111 and a top portion 112. The PCD enhanced insert is made in a can 113 having an inside geometry complimentary to the geometry of the top portion 112. The can 113 and a cap 114 are typically made of niobium or other refractory metals. The can is placed in a temporary die or fixture 116 having a cavity that is complimentary to the outside geometry of the can. One or more layers of high-shear compaction tape containing the desired superhard material compositions are placed in the hemispherical end of the can. In fact, the can serves as a mold for shaping the layer.

Figure 12:
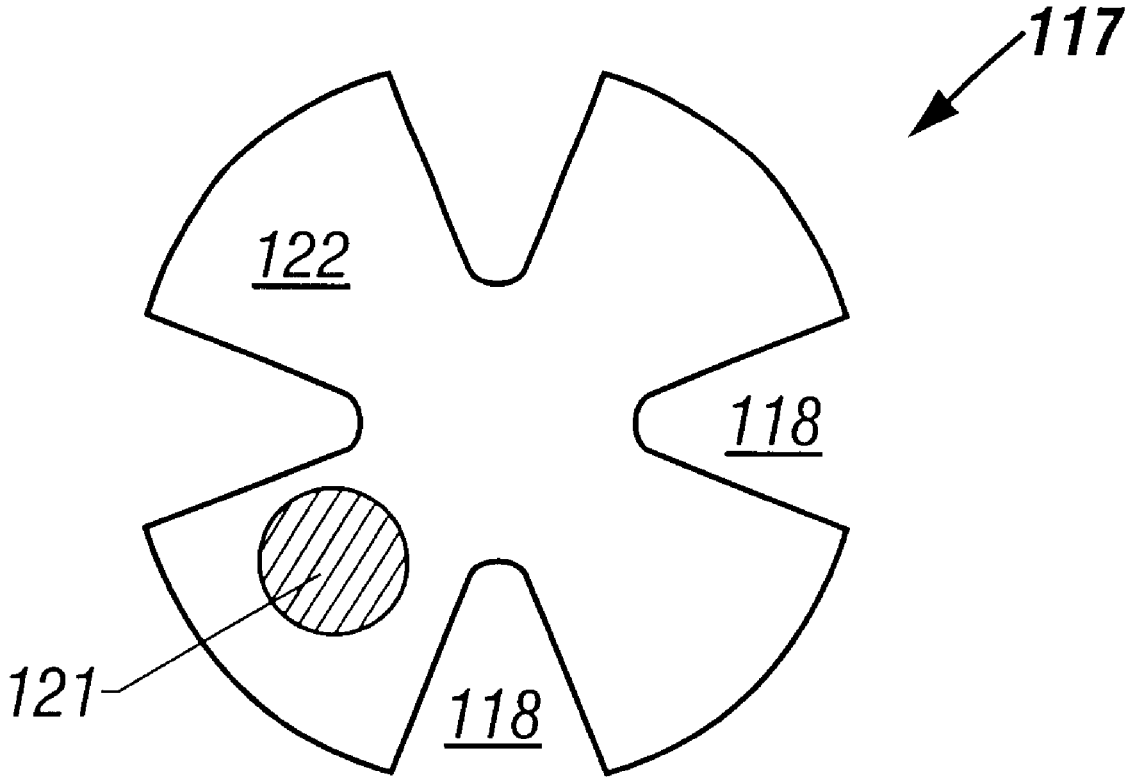
FIG. 12 is a top view of a preformed high-shear compaction tape used in FIG. 11.

Each layer comprises a preform cut from a sheet of high-shear compaction tape material. An exemplary preform for fitting a hemispherical top portion of an insert is illustrated in FIG. 12. The preform is a circular disk with four generally V-shaped notches 11 8 extending from the circumference towards the center. The notches permit the flat preform to bend into the hemispherical form of the can without extensive folding, buckling, or doubling of thickness. It should be noted that the high-shear compaction material 117 includes two areas: region 121 and region 122. The region 121 includes a superhard material that will result in a higher toughness or lower wear resistance than the superhard material in the region 122. High-compaction tapes with two regions of superhard material may be made in a multiple roller process or by "cut-and-paste" after the roller process.

If one or more transition layers are desired, additional tapes containing appropriate superhard material compositions may be used. Similar to the outer layer, a transition layer typically is formed of particles of a superhard material (such as diamond or boron nitride) dispersed in a metal matrix (such as cobalt); but the relative weight percentages may be different from that of the outer layer.

After tapes 117 are fitted into the can 113, the insert (or a punch having the same shape as the insert) is then pressed into the can to smooth and form the layer of high-shear compaction material in the end of the can. After the material is smoothed, the insert body is placed in the can (if not already there from smoothing), and the can is removed from the fixture 116. The organic binder in the high-shear compaction material is removed in a subsequent dewaxing process. A refractory metal cap 114 is placed around and over the open end of the can 113 to seal the cemented tungsten carbide body and superhard material inside the resulting assembly. Such an assembly subsequently is placed in a high pressure and high temperature press for formation of a polycrystalline diamond layer over the tungsten carbide substrate.

Instead of using a high-shear compaction tape with two regions of different superhard materials, two separate high-shear compaction tapes with different superhard material compositions may be used in alternative embodiments. In these embodiments, a slight modification of the above-described process is necessary. The first high-shear compaction tape with a first superhard material composition is loaded into the can 113 which has a complimentary inside geometry to that of the top portion 112. A dummy insert (not shown in FIG. 11) with an identical geometry to the insert is placed into the can 113. The dummy insert is used as a jig for cutting a hole in the first high-shear compaction tape in the location where the second compaction tape with a second superhard material composition is desired to be placed. After the hole is cut in the first high-shear compaction tape, the dummy insert and the cut piece are removed, and the second piece of tape with an identical shape to the hole cut in the first tape is placed in the hole. A composite tape structure that includes two different high-shear compaction tapes located in different regions is obtained. Furthermore, this composite tape structure conforms to the outer geometry of the top portion 112. If the top portion 112 has an asymmetrical geometry, there is only one way that the insert could be fitted into the can 113 that includes the composite tape structure. Therefore, this modified process has the advantage of accurately bonding the different superhard materials to the desired regions of an insert. After the insert is placed into the can 113, the subsequent steps are identical to the above described process.

In preferred embodiments, the first region 121 of FIG. 12 is in the shape of a circle. This is done primarily to facilitate the manufacturing process. Various geometric shapes, including without limitation a square, a triangle, an oval, a rectangle, a semicircle, a corrugated semicircle, etc., may be employed in embodiments of the invention.

In addition to the high-shear compaction tapes, composite construction materials including a superhard material also may be used to manufacture the improved inserts in accordance with embodiments of the invention. Suitable composite construction materials are disclosed in a pending U.S. patent application Ser. No. 08/903,668, entitled "Composite Constructions with Oriented Microstructure," filed on Jul. 31, 1997, and the disclosure of this patent application is incorporated by reference herein in its entirety.

Generally, the composite construction materials include an oriented microstructure comprising arrangements of hard phase materials such as polycrystalline diamond or polycrystalline cubic boron nitride, and relatively softer binder phase materials such as metals, metal alloys, and in some instances cement materials. FIG. 13 illustrates two embodiments of the composite construction material.

Figure 13A:
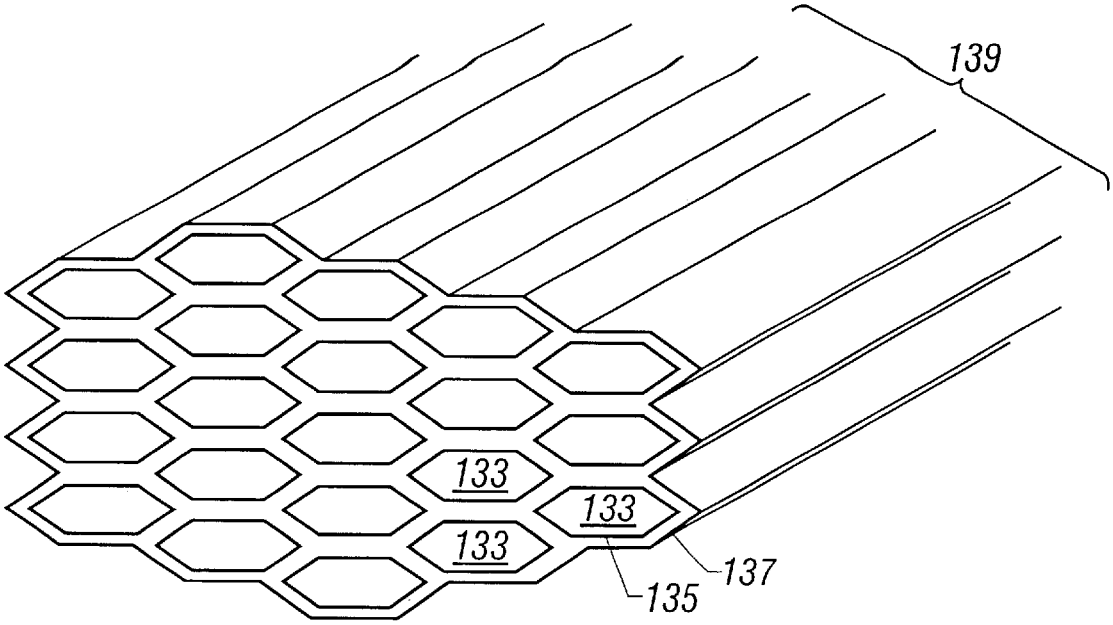
FIG. 13A is a perspective view of one embodiment of the composite construction material used in embodiments of the invention.

Referring to FIG. 13A, a first embodiment of the composite construction material includes a plurality of cased or coated fibers 133 that are bundled together. Each fiber 133 comprises a core 135 formed from a hard phase material such as polycrystalline diamond or polycrystalline cubic boron nitride. Each core 135 is surrounded by a shell or casing 137 formed from a binder phase material such as cobalt. The plurality of coated fibers 133 are oriented parallel to a common axis and are bundled together and extruded into a rod 139. This rod includes a cellular composite construction made up of binder phase material with hard phase material cores. These rods may be cut into small discs, and these discs may further be cut into the shape of the high-shear compaction tape 117 of FIG. 12 for use to manufacture the improved inserts in the above-described processes.

Figure 13B:
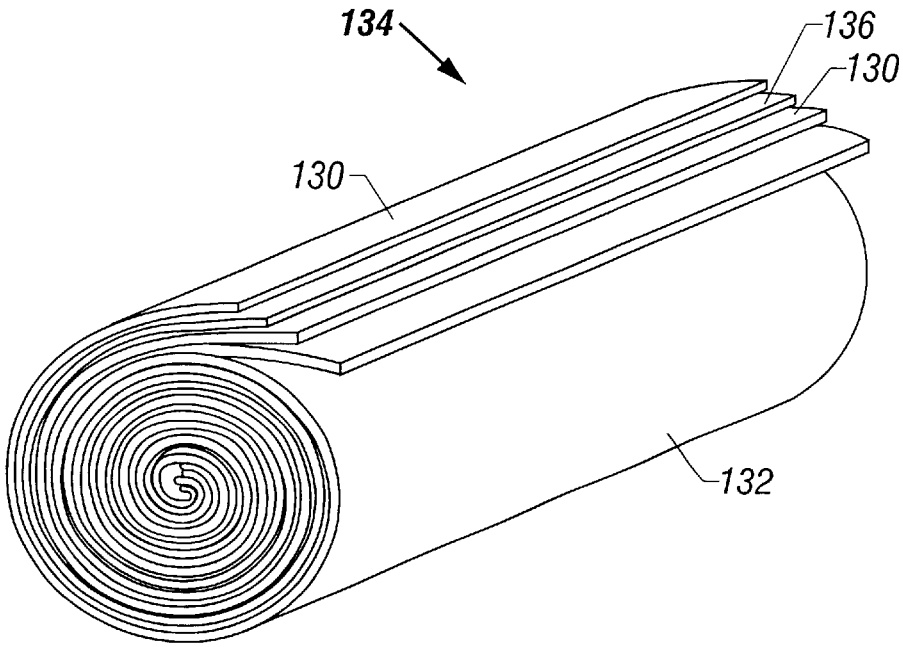
FIG. 13B is a perspective view of another embodiment of the composite construction material used in embodiments of the invention.

FIG. 13B illustrates another embodiment of the composite construction material. Referring to FIG. 13B, the composite construction material 134 includes a repeating arrangement of monolithic sheets 136 of a hard phase material and binder sheets 130 that are arranged to produce a spiral or coiled composite construction. The monolithic sheets 136 may be formed from polycrystalline diamond or polycrystalline cubic boron nitride, and the binder sheets 130 may be formed from relatively ductile materials such as cobalt. Such a composite construction may be formed into a rod. Similar to the first embodiment, such rods may be cut into small discs for use in the manufacturing of the improved inserts.

Figure 16:
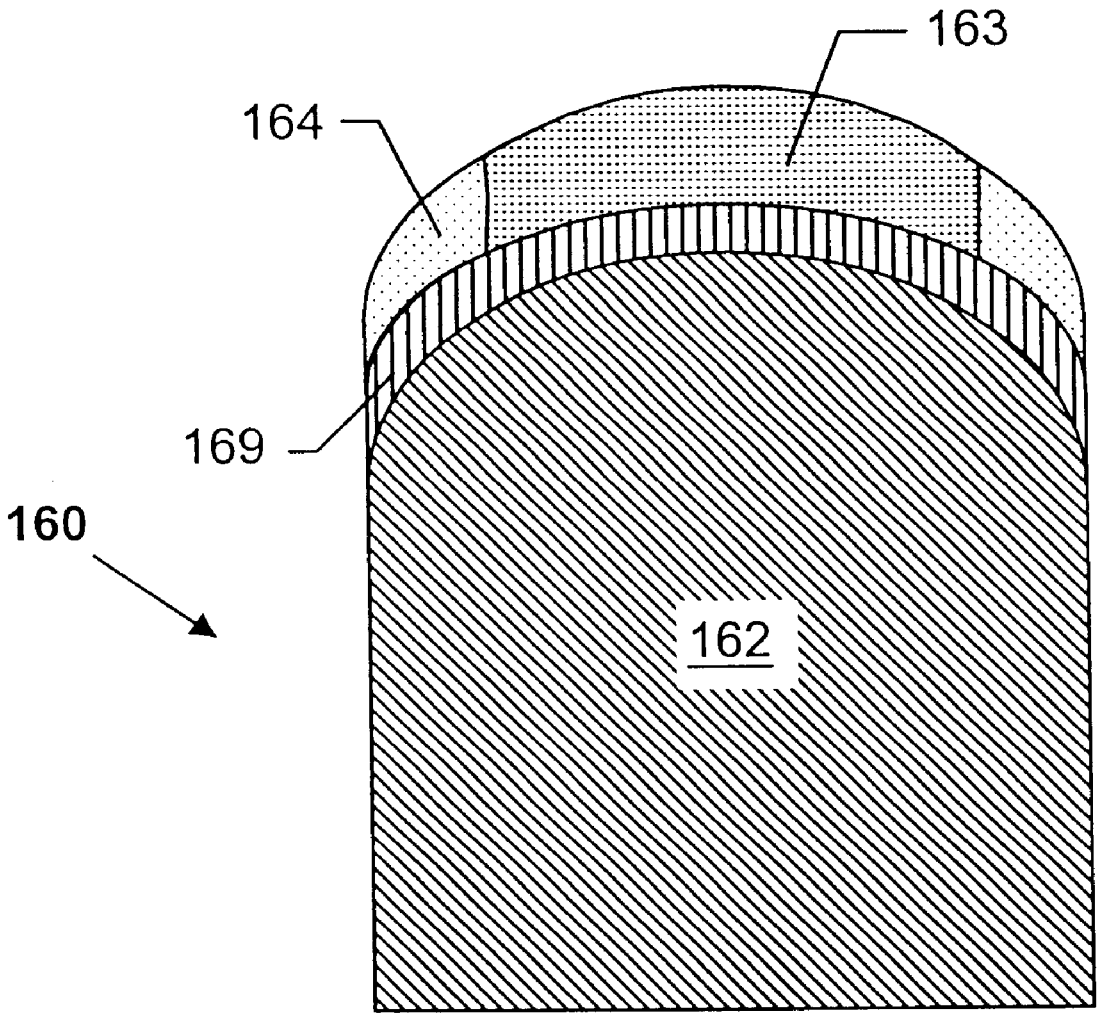
FIG. 16 is a cross-sectional view of an improved insert in accordance with an embodiment of the invention.

It should be noted that, in some embodiments, the polycrystalline diamond layer is directly bonded to the tungsten carbide substrate. In other embodiments, such as the embodiment of an improved insert 160 shown in FIG. 16, one or more transition layers 169 arc placed between the polycrystalline diamond layer (region 163 and region 164) and the substrate 162 to strengthen the bonding therebetween. Instead of or in addition to transition layers, an irregular interface (also referred to as "non-planar interface") along a curved surface between the polycrystalline diamond and the substrate may be employed. Various configurations of irregular interface are suitable. For example, U.S. Pat. No. 4,629,373 to Hall, entitled "Polycrystalline Diamond Body With Enhanced Surface Irregularities," discloses various irregular interfaces.

The enhanced inserts according to embodiments of the invention have many applications. For example, it may be used in an earth-boring bit, such as a percussion bit and a roller cone bit for petroleum or mining applications.

Figure 14:
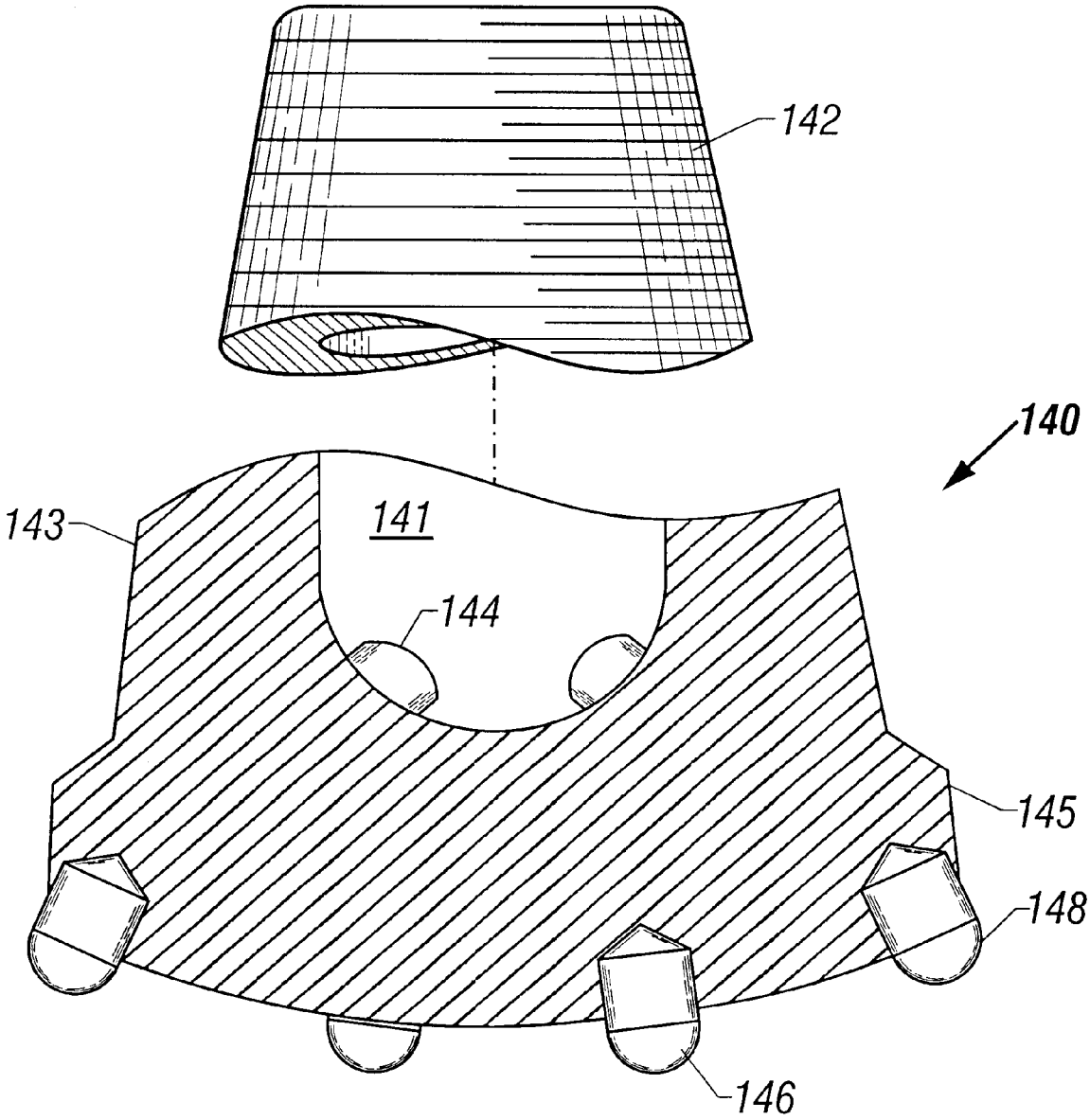
FIG. 14 is a fragmentary longitudinal cross-sectional view of a percussion bit in accordance with an embodiment of the invention.

FIG. 14 is a fragmentary longitudinal cross section of an exemplary percussion rock bit. The bit 140 comprises a hollow steel body 143 having a threaded pin 142 at the upper end of the body for assembly of the bit onto a drill string for drilling oil wells and the like. The body 143, which also may be referred to as a "retention body," includes a cavity 141 and end holes 144 communicating between the cavity and the surface of the body. The lower end of the body terminates in a head 145. The head is enlarged relative to the body 143 and is somewhat rounded in shape. A plurality of inserts 146 are provided in the surface of the head for bearing on the rock formation being drilled. The inserts provide the drilling action by engaging and crushing rock formation on the bottom of a borehole being drilled as the rock bit rotates and strikes the rock in a percussive motion. The outer row of inserts 148 on the head are the improved inserts according to embodiments of the invention. The improved inserts also may be used to replace the inserts 146, which are typically formed of cemented tungsten carbide. It is to be noted that the polycrystalline diamond layer of an insert of a percussion bit experiences some wear. Therefore, it may be desirable to place a more wear-resistant polycrystalline diamond layer in the area where the wear is most severe.

Figure 15:
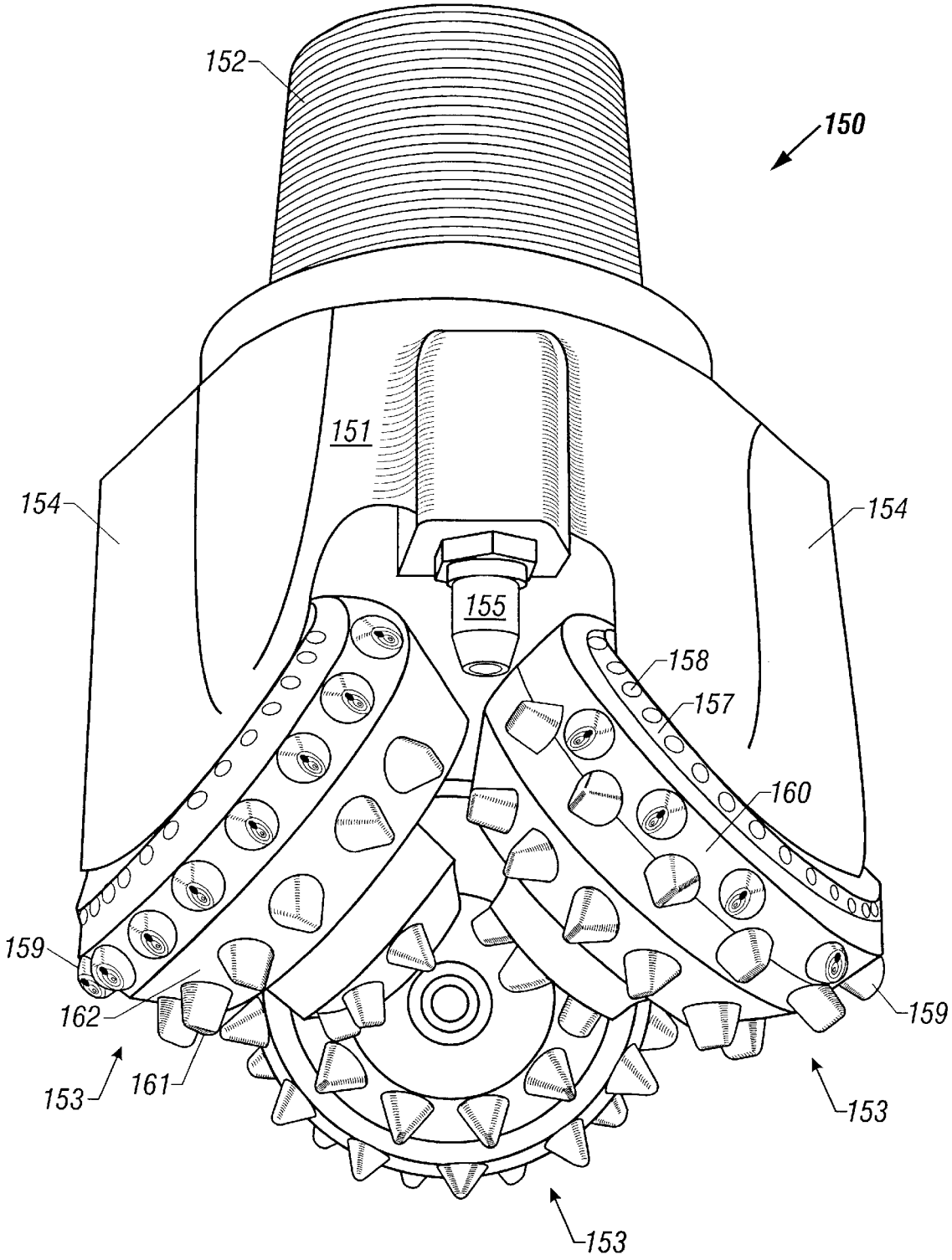
FIG. 15 is a perspective view of a rock bit manufactured in accordance with an embodiment of the invention.

FIG. 15 shows a perspective view of a rock bit constructed with the improved inserts according to embodiments of the invention. A rock bit 150 includes a bit body 151, having a threaded section 152 on its upper end for securing the bit to a drill string (not shown). The bit 150 generally has three roller cones 153 rotatably mounted on bearing shafts (hidden) that extend from the bit body 151. The bit body 151 is composed of three sections or legs 154 (two legs are shown) that are welded together to form the bit body. The bit 150 further includes a plurality of nozzles 155 that arc provided for directing drilling fluid towards the bottom of a borehole and around the roller cones 153.

Generally, the roller cones 153 include a frustoconical surface 157 that is adapted to retain heel row inserts 158 that scrape or ream the side wall of a borehole as the roller cones rotate about the borehole bottom. The frustoconical surface 157 is referred to herein as the heel surface of the roller cone, although the same surface may sometimes be referred to by others in the art as the gage surface of the roller cone.

In addition to the heel row inserts 158, the roller cone 153 also includes a circumferential row of gage inserts 159 secured to the roller cone in locations along or near the circumferential shoulder 160 that cut the corner of the borehole to a full gage diameter. The gage inserts typically cut the borehole corner by a combination of shearing and crushing actions. The roller cone 153 further includes a plurality of inner row inserts 161 secured to the roller cone surface 162. These inner row inserts usually are arranged and spaced apart in respective rows. As the roller cone rotates about its rotational axis, the inner row inserts cut the borehole bottom by gouging and crushing the rock. The term "cutting" or "cut" used herein means any mechanical action that chips, fractures, separates or removes a rock formation.

It is apparent that the improved inserts according to embodiments of the invention may be used as gage row inserts, off-gage inserts, heel row inserts, nestled gage inserts, and inner row inserts. Although a petroleum rock bit is illustrated in FIG. 15, a mining rock bit may be manufactured in a similar manner. A mining rock bit typically is used to drill relatively shallow blast holes with air being used as the drilling fluid.

In addition to the above applications, the invention also may be applied to a roller cone with cutting elements integrally formed thereon ("the integrated roller cone). The body of the integrated roller cone and the cutting elements are made from a single piece of suitable material, and the cutting elements typically protrude from the surface of the roller cone body. For example, a milled-tooth cone is one such integrated roller cone. Of course, the integrated roller cones need not be milled, and they may be made from a variety of materials, not just steel. The cutting elements generally are in the shape of a tooth, although other shapes are acceptable. Similar to the top portion of an insert, the cutting element may include one or more of the following faces: a crest, a leading face, a leading edge, a trailing face, a trailing edge, an outer lateral face, etc. In accordance with embodiments of the invention, the cutting elements may be provided with a layer of superhard material having two or more regions. The superhard material in one region is different from the superhard material in another region. After an integrated roller cone is provided with a layer of superhard material, it may be attached to the leg of a rock bit body to assembly a rock bit.

As described above, embodiments of the invention provide an improved insert which may reduce and minimize the formation and propagation of localized chipping of a superhard material layer. An earth-boring bit incorporating such improved inserts should experience longer lifetime, higher total drilling footage, and higher rate of penetration in operation. Other properties and advantages may be apparent to a person of ordinary skill in the art.

While the invention has been disclosed with respect to a limited number of embodiments, numerous modifications and variations therefrom are possible. For example, the improved insert may be used in any wear-resistant application, not just those described herein. While a layer of superhard material is preferred, other forms of superhard material (such as a diamond pad or chuck) may be provided on the top portion of an insert Although the embodiments of the invention are described with respect to two regions of superhard material with a different composition, the improved insert may include multiple regions, and each region is provided with a suitable superhard material composition commensurate with the wear and impact to which the region is subjected. Furthermore, the methods suitable for manufacturing the improved inserts are not limited to the high pressure and high temperature process. Any compaction method that bonds a layer of superhard material to a substrate may be employed. While embodiments of the invention have been described with respect to a PCD enhanced insert, it should be noted that the invention equally applies to inserts that utilize polycrystalline boron nitride or other superhard materials. Generally, inserts arc not recessed in their respective insert holes in a conventional rock bit. However, in some instances, the inserts may be recessed. Furthermore, the body portion of the insert may either be completely secured in the roller cone or partially protrude from the roller cone. It is intended that appended claims cover all such modifications and their variations as fall within the true spirit and the scope of the invention.

What is claimed is:

1. An insert for an earth-boring bit, comprising:

a body portion adapted for attachment to the earth-boring bit; and a non-cylindrical top portion for contacting an earthen formation to be drilled, the top portion including superhard material having a first region and a second region on an exterior surface thereof, the superhard material in the first region having a composition different from the superhard material in the second region.

2. The insert of claim 1, wherein the top portion includes a substrate and a layer of the superhard material provided over at least a portion of the substrate.

3. The insert of claim 2, wherein the top portion includes a transition layer between the substrate and the layer of superhard material.

4. The insert of claim 3, wherein the transition layer includes diamond particles and tungsten carbide particles.

5. The insert of claim 2, wherein the top portion includes a plurality of transition layers between the substrate and the layer of superhard material.

6. The insert of claim 2, wherein the substrate and the layer of superhard material in the first region include an irregular interface.

7. The insert of claim 1, wherein the superhard material in the first region has a higher toughness than the superhard material in the second region.

8. The insert of claim 7, wherein insert includes a primary surface, and the first region lies in the primary surface.

9. The insert of claim 1, wherein the superhard material in the first region has a lower wear resistance than the superhard material in the second region.

10. The insert of claim 9, wherein insert includes a primary surface, and the first region lies in the primary surface.

11. The insert of claim 1, wherein the hardness of the superhard material in the first region is at least 500 Vickers lower than the hardness of the superhard material in the second region.

12. The insert of claim 1, wherein the superhard material includes cubic boron nitride.

13. The insert of claim 1, wherein the superhard material includes diamond.

14. The insert of claim 1, wherein the superhard material of at least one region includes diamond particles and a metal selected from the group consisting of cobalt, nickel, iron, and alloys thereof.

15. The insert of claim 14, wherein the superhard material of at least one region further includes particles of carbide or carbonitride of elements selected from the group consisting of tungsten, titanium, tantalum, chromium, molybdenum, vanadium, hafnium, zirconium, and alloys thereof.

16. The insert of claim 1, wherein the superhard material includes diamond particles and cobalt, and the cobalt content in the first region is different from the cobalt content in the second region.

17. The insert of claim 1, wherein the superhard material includes diamond particles and cobalt, and the nominal diamond particle size in the first region is different from the nominal diamond particle size in the second region.

18. The insert of claim 1, wherein the superhard material includes cobalt and diamond particles, and the cobalt content in the first region differs from the cobalt content in the second region by at least about 20% by weight.

19. The insert of claim 1, wherein the superhard material includes WC, cobalt and diamond particles, and the WC content in the first region is at least 30% by weight of the superhard material, and the WC content in the second region is less than 10% by weight of the superhard material.

20. The insert of claim 1, wherein the top portion is asymmetrical.

21. The insert of claim 1, wherein the insert is a shaped insert.

22. The insert of claim 1, wherein the insert includes a substantially cylindrical body portion and a substantially chisel-shaped top portion.

23. The insert of claim 1, wherein the insert includes a substantially cylindrical body portion and a substantially semi-round top portion.

24. The insert of claim 1, wherein the insert includes a substantially cylindrical body portion and a substantially ballistic top portion.

25. The insert of claim 1, wherein the insert includes a substantially cylindrical body portion and a substantially asymmetrical top portion.

26. The insert of claim 1, wherein insert is formed of a carbide composition.

27. The insert of claim 1, wherein the superhard material comprises a plurality of non-contiguous regions.

28. The insert of claim 1, wherein the first region of superhard material is not contiguous with the second region of superhard material.

29. A PCD enhanced insert for an earth-boring bit, comprising:

a substantially cylindrical body portion adapted for attachment to the earth-boring bit, the body portion formed of cemented tungsten carbide; and a non-cylindrical top portion for contacting an earthen formation to be drilled, the top portion having a primary surface and secondary surface, the top portion including a cemented tungsten carbide substrate and a polycrystalline diamond layer over at least a portion of the substrate, the polycrystalline diamond in the primary surface having a lower wear resistance than the polycrystalline diamond in the secondary surface of the top portion.

30. A rock bit, comprising:

a bit body;

a roller cone rotatably mounted on the bit body; and an insert having a body portion and a top portion, the body portion secured in the roller cone, the top portion including superhard material having a first region and a second region on an exterior surface thereof, the superhard material in the first region having a composition different from the superhard material in the second region.

31. The rock bit of claim 30, wherein the top portion includes a substrate and a layer of the superhard material provided over at least a portion of the substrate.

32. The rock bit of claim 31, wherein the insert includes an irregular interface between the substrate and the layer of superhard material.

33. The rock bit of claim 31, wherein the insert includes a transition layer between the substrate and the layer of superhard material.

34. The rock bit of claim 30, wherein the hardness of the superhard material in the first region is at least 500 Vickers lower than the hardness of the superhard material in the second region.

35. The rock bit of claim 30, wherein the top portion is non-cylindrical.

36. The rock bit of claim 30, wherein the superhard material includes polycrystalline diamond.

37. The rock bit of claim 36, wherein the polycrystalline diamond in the first region is less wear-resistant than the polycrystalline diamond in the second region.

38. The rock bit of claim 37, wherein the insert includes a primary surface, and the first region is located in the primary surface.

39. The rock bit of claim 30, wherein the roller cone further includes a gage row, and the insert is located on the gage row.

40. The rock bit of claim 30, wherein the roller cone further includes a heel row, and the insert is located on the heel row.

41. The rock bit of claim 30, wherein the roller cone further includes an inner row, and the insert is located on the inner row.

42. The rock bit of claim 30, wherein the roller cone further includes a nestled gage row, and the insert is located on the nestled gage row.

43. The rock bit of claim 30, wherein the insert includes a substantially cylindrical body portion and a substantially chisel-shaped top portion.

44. The rock bit of claim 30, wherein the insert includes a substantially cylindrical body portion and a substantially semi-round top portion.

45. The rock bit of claim 30, wherein the insert includes a substantially cylindrical body portion and a substantially ballistic top portion.

46. The rock bit of claim 30, wherein the insert includes a substantially cylindrical body portion and a substantially asymmetrical top portion.

47. The rock bit of claim 30, wherein the insert includes a primary surface, and the first region of the superhard material is located at least partially in the primary surface.

48. The rock bit of claim 30, wherein the insert includes a leading edge, and the first region of the superhard material is located at least partially in the leading edge.

49. The rock bit of claim 30, wherein the insert includes a leading face, and the first region of the superhard material is located at least partially in the leading face.

50. The rock bit of claim 30, wherein the insert includes a leading transition, and the first region of the superhard material is located at least partially in the leading transition.

51. The rock bit of claim 30, wherein the insert includes a trailing edge, and the first region of the superhard material is located at least partially in the trailing edge.

52. The rock bit of claim 30, wherein the insert includes a trailing face, and the first region of the superhard material is located at least partially in the trailing face.

53. The rock bit of claim 30, wherein the insert includes a trailing transition, and the first region of the superhard material is located at least partially in the trailing transition.

54. The rock bit of claim 30, wherein the insert includes a crest, and the first region of the superhard material is located at least partially in the crest.

55. The rock bit of claim 30, wherein the first region includes a gage contact face and a leading transition, and the second region includes a trailing edge, a trailing face and a crest.

56. The rock bit of claim 30, wherein the rock bit is used to form a borehole having a sidewall, a corner, and a bottom.

57. The rock bit of claim 56, wherein the insert cuts the borehole sidewall as the roller cone rotates.

58. The rock bit of claim 57, wherein the insert cuts the borehole sidewall to a full diameter as the roller cone rotates.

59. The rock bit of claim 56, wherein the insert cuts the corner of the borehole as the roller cone rotates.

60. The rock bit of claim 56, wherein the insert cuts the bottom of the borehole as the roller cone rotates.

61. The rock bit of claim 56, wherein the insert includes a gage contact face located in the first region, the wear resistance of the superhard material in the first region is less than the wear resistance of the superhard material in the second region.

62. The rock bit of claim 30, wherein a cutting edge forms when less wear resistant superhard material in wears away.

63. A rock bit, comprising:

a bit body;

a roller cone rotatably mounted on the bit body; and a plurality of inserts having a substantially cylindrical body and a non-cylindrical top portion, the body portion secured in the roller cone, the top portion including a substrate and a polycrystalline diamond layer over at least a portion of the substrate, the top portion having a primary surface and secondary surface, the polycrystalline diamond in the primary surface having a higher toughness or lower wear resistance than the polycrystalline diamond in the secondary surface of the top portion.

64. An earth-boring bit, comprising:

a retention body; and an insert having a body portion and a non-cylindrical top portion, the body portion being secured in the retention body, the top portion including superhard material having a first region and a second region on an exterior surface thereof, the superhard material in the first region having a composition different from the superhard material in the second region.

65. A rock bit, comprising:

a bit body; and a roller cone rotatably mounted on the bit body, the roller cone having cutting elements integrally formed thereon, the cutting elements including superhard material having a first region and a second region on an exterior surface thereof, the superhard material in the first region having a composition different from the superhard material in the second region.

66. A method of manufacturing a rock bit, comprising:

providing a bit body;

rotatably mounting a roller cone to the bit body; and attaching an insert to the roller cone, the insert having a body portion and a top portion, the body portion secured in the roller cone, the top portion including superhard material having a first region and a second region on an exterior surface thereof, the superhard material in the first region having a composition different from the superhard material in the second region.

67. A method of manufacturing an earth-boring bit, comprising:

providing a retention body; and attaching an insert to the retention body, the insert having a body portion and a non-cylindrical top portion, the body portion secured in the retention body, the top portion including superhard material having a first region and a second region on an exterior surface thereof, the superhard material in the first region having a composition different from the superhard material in the second region.

68. A method of manufacturing a rock bit, comprising:

providing a roller cone having cutting elements integrally formed thereon, the cutting elements having a surface;

providing superhard material over at least a portion of the surface of the cutting elements, the superhard material having a first region and a second region on an exterior surface thereof, the superhard material in the first region having a composition different from the superhard material in the second region; and rotatably mounting the integrated roller cone to a leg of a bit body.

* * * * *